US011308881B2

(12) United States Patent
Ueno

(10) Patent No.: US 11,308,881 B2
(45) **Date of Patent: *Apr. 19, 2022**

(54) DISPLAY DEVICE AND METHOD FOR DRIVING SAME

(71) Applicant: SHARP KABUSHIKI KAISHA, Sakai (JP)

(72) Inventor: Tetsuya Ueno, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/277,267

(22) PCT Filed: Sep. 20, 2018

(86) PCT No.: PCT/JP2018/034774
§ 371 (c)(1),
(2) Date: Mar. 17, 2021

(87) PCT Pub. No.: WO2020/059071
PCT Pub. Date: Mar. 26, 2020

(65) Prior Publication Data

US 2021/0319750 A1 Oct. 14, 2021

(51) Int. Cl.
*G09G 3/3233* (2016.01)
*G09G 3/20* (2006.01)
(Continued)

(52) U.S. Cl.
CPC ..... *G09G 3/3233* (2013.01); *G09G 3/2092* (2013.01); *G09G 3/3266* (2013.01);
(Continued)

(58) Field of Classification Search
CPC ..... G09G 2320/0233
See application file for complete search history.

(56) References Cited

U.S. PATENT DOCUMENTS 8,400,380 B2 * 3/2013 Lee ..... G09G 3/3233 345/83
10,249,239 B2 * 4/2019 Wang ..... G09G 3/3275
(Continued)

FOREIGN PATENT DOCUMENTS

JP 2009-216801 A 9/2009
JP 2011-027819 A 2/2011
(Continued)

*Primary Examiner* — Sepehr Azari
(74) *Attorney, Agent, or Firm* — ScienBiziP, P.C.

(57) ABSTRACT

The present application discloses a current-driven display device capable of preventing a decrease in display quality due to luminance gradient or the like caused by a voltage drop in a power supply line while preventing an increase in circuit and processing necessary for driving a pixel circuit. In an organic EL display device, at a connection point of a high-level power supply line ELVDD with a pixel circuit 15 (Pix(n,k)) (n=1 to N; k=1 to M) on each branch wire ELVk, a display control circuit calculates a voltage drop ΔVn=V0−Vn caused by a current flowing in the branch wire ELVk in a data write period for the pixel circuit Pix(n,k), corrects corresponding pixel data (pixel data for Pix(n,k)) dn in input image data based on the voltage drop ΔVn, and generates a driving image data signal Sdda to be given to a data-side drive circuit based on the corrected pixel data dcn.

13 Claims, 7 Drawing Sheets

(51) Int. Cl.
*G09G 3/3266* (2016.01)
*G09G 3/3291* (2016.01)

(52) U.S. Cl.
CPC ... *G09G 3/3291* (2013.01); *G09G 2320/0233* (2013.01); *G09G 2330/028* (2013.01); *G09G 2360/12* (2013.01); *G09G 2360/16* (2013.01)

(56) References Cited

U.S. PATENT DOCUMENTS

2009/0225072 A1* 9/2009 Mizukoshi ..... G09G 3/3233 345/214
2009/0244054 A1* 10/2009 Lee ..... G09G 3/3233 345/213
2011/0018787 A1 1/2011 Nakamura et al.
2012/0169707 A1* 7/2012 Ebisuno ..... G09G 3/3233 345/212
2012/0236041 A1* 9/2012 Oh ..... G09G 3/3233 345/212
2012/0249514 A1* 10/2012 Ahn ..... G09G 3/3233 345/82
2014/0375700 A1* 12/2014 Takahama ..... G09G 3/2003 345/77
2015/0269887 A1 9/2015 Liu et al.
2016/0012768 A1* 1/2016 In ..... G09G 3/3225 345/82
2016/0125807 A1* 5/2016 Wang ..... G09G 3/3258 345/205
2017/0294160 A1* 10/2017 Ono ..... G09G 3/3233
2021/0319749 A1* 10/2021 Ueno ..... G09G 3/3266

FOREIGN PATENT DOCUMENTS

JP 2011-095506 A 5/2011
JP 2016-504612 A 2/2016
WO 2013/136998 A1 9/2013

* cited by examiner

DISPLAY DEVICE AND METHOD FOR DRIVING SAME

TECHNICAL FIELD

The disclosure relates to a display device, and more particularly relates to a current-driven type display device including a display element driven by current, such as an organic electroluminescence (EL) display device, and a method for driving the display device.

BACKGROUND ART

In recent years, an organic EL display device having a pixel circuit, which includes an organic EL element (also called organic light-emitting diode: OLED), has been put into practical use. The pixel circuit of the organic EL display device includes, in addition to the organic EL element, a drive transistor, a write control transistor, a holding capacitor, and the like. A thin-film transistor is used for the drive transistor and the write control transistor, the holding capacitor is connected to a gate terminal serving as a control terminal of the drive transistor, and a voltage that corresponds to a video signal representing an image to be displayed (more specifically, a voltage that indicates a gradation value of a pixel to be formed in the pixel circuit and will be hereinafter referred to as "data voltage") is applied to the holding capacitor via a data signal line from a drive circuit. The organic EL element is a self-luminous display element that emits light at a luminance corresponding to a current flowing therein. The drive transistor is provided in series with the organic EL element and controls the current flowing through the organic EL element in accordance with the voltage held by the holding capacitor.

In a display portion of the organic EL display device, a plurality of pixel circuits are arranged in a matrix form, and a power supply line is disposed to supply a current to the organic EL element in each pixel circuit. With the power supply line having wiring resistance, a voltage drop occurs in the power supply line due to the current supplied to the organic EL element in the pixel circuit connected to the power supply line, and the voltage held in the holding capacitor of each pixel circuit is affected by the voltage drop. Thus, even when the same data voltage is applied to each pixel circuit, the voltage held by the holding capacitor is slightly different, and the display luminance is slightly different depending on the position in the display portion. This is sometimes seen as a luminance gradient in a display image, and a phenomenon in which such a luminance gradient appears is also referred to as a "shading phenomenon".

As a technique for improving the shading phenomenon, for example, the following are considered as described in Patent Document 1: a technique of increasing the number of power supplies to prevent a voltage drop in a current supply wire (power supply line) (hereinafter referred to as "first technique"); and a technique of correcting a write voltage for a display element (an organic EL element of a pixel circuit) connected to one current supply wire (power supply line) in accordance with the relative position of the display element to the power supply (hereinafter referred to as "second technique") (see paragraphs[0008] to[0013] of Patent Document 1). Further, Patent Document 1 discloses an organic EL display device (hereinafter referred to as "known example") configured to adjust a voltage, which is applied to a gate terminal of a drive transistor 202 in each pixel circuit 15 via a holding capacitor 201, in accordance with a voltage drop at each position of a current supply wire 16 of a display region 17 in emission period T2 in order to prevent the shading phenomenon (see paragraphs[0060] to[0065] and FIGS. 2 to 4). Note that an organic EL display device having such a configuration is also disclosed in Patent Document 2 (see paragraphs[0031] to[0040] and FIGS. 2 to 4).

CITATION LIST

Patent Documents

[Patent Document 1] JP 2011-95506 A
[Patent Document 2] JP 2011-27819 A

SUMMARY

Technical Problem

However, in the first technique, an increase in the number of power supplies causes an increase in the cost and size of the display device. In the second technique, the processing is required to determine the write voltage (data voltage) to be written in each display element (pixel circuit) in accordance with the position of the display element in the current supply wire (power supply line), thereby increasing the cost and circuit amount. On the other hand, in the known example which is the organic EL display device disclosed in Patent Document 1, it is possible to prevent the occurrence of the luminance gradient (shading phenomenon) in the display image while preventing an increase in circuit scale as compared to the first technique and the like. However, a data line for transmitting the data voltage to be written in the pixel circuit is also used to correct a voltage that is applied to the gate terminal of the drive transistor of the display element (pixel circuit) in an emission period, and hence the ratio of the emission period in one frame period cannot be increased (see paragraphs[0053], [0060] to[0063], and FIG. 4) of Patent Document 1).

Therefore, it is desired to provide a current-driven display device capable of preventing a decrease in display quality due to a luminance gradient or the like caused by a voltage drop in a power supply line while preventing an increase in circuit and processing necessary for driving a pixel circuit, without lowering the ratio of an emission period.

Solution to Problem

Several embodiments of the disclosure provide a display device having a plurality of scanning signal lines extending in a row direction, a plurality of data signal lines extending in a column direction and intersecting the plurality of scanning signal lines, and a plurality of pixel circuits arranged in a matrix form along the plurality of scanning signal lines and the plurality of data signal lines, the display device including:

a power supply line including first and second power supply voltage lines;

an image data correction unit configured to generate driving image data by correcting input image data that represents an image to be displayed;

a data signal line drive circuit configured to drive the plurality of data signal lines based on the driving image data generated by the image data correction unit; and a scanning signal line drive circuit configured to selectively drive the plurality of scanning signal lines, wherein the first power supply voltage line includes a trunk wire, and a plurality of branch wires diverging from the trunk wire and arranged along the plurality of data signal lines, respectively, each of the pixel circuits corresponds to any one of the plurality of scanning signal lines, corresponds to any one of the plurality of data signal lines, and corresponds to any one of the plurality of branch lines, includes a display element driven by a current, a holding capacitor configured to hold a data voltage for controlling a drive current of the display element, and a drive transistor configured to control the drive current of the display element in accordance with the data voltage held in the holding capacitor, and is configured such that a voltage of a corresponding data signal line is written in the holding capacitor as a data voltage when a corresponding scanning signal line is selected, in each of the pixel circuits, a first conductive terminal of the drive transistor is connected to a branch wire corresponding to the each pixel circuit, a second conductive terminal of the drive transistor is connected to the second power supply voltage line via the display element, and a control terminal of the drive transistor is connected to the corresponding branch wire via the holding capacitor, and the image data correction unit obtains an estimated value of a current that flows in a branch wire corresponding to any one of the plurality of pixel circuits when a data voltage is written in the any one pixel circuit, determines a voltage drop at a connection point between the branch wire and the any one pixel circuit based on the estimated value of the current, and corrects image data for the any one pixel circuit out of the input image data in accordance with the voltage drop, so as to generate image data corresponding to the data voltage to be written in the any one pixel circuit out of the driving image data.

Several other embodiments of the disclosure provide a method for diving a display device that includes a plurality of scanning signal lines extending in a row direction, a plurality of data signal lines extending in a column direction and intersecting the plurality of scanning signal lines, a power supply line including first and second power supply voltage lines, and a plurality of pixel circuits arranged in a matrix form along the plurality of scanning signal lines and the plurality of data signal lines, the method including:

an image data correction step of generating driving image data by correcting input image data that represents an image to be displayed;

a data signal line drive step of driving the plurality of data signal lines based on the driving image data; and a scanning signal line drive step of selectively driving the plurality of scanning signal lines, wherein the first power supply voltage line includes a trunk wire, and a plurality of branch wires diverging from the trunk wire and arranged along the plurality of data signal lines, respectively, each of the pixel circuits corresponds to any one of the plurality of scanning signal lines, corresponds to any one of the plurality of data signal lines, and corresponds to any one of the plurality of branch lines, includes a display element driven by a current, a holding capacitor configured to hold a data voltage for controlling a drive current of the display element, and a drive transistor configured to control the drive current of the display element in accordance with the data voltage held in the holding capacitor, and is configured such that a voltage of a corresponding data signal line is written in the holding capacitor as a data voltage when a corresponding scanning signal line is selected, in each of the pixel circuits, a first conductive terminal of the drive transistor is connected to a branch wire corresponding to the each pixel circuit, a second conductive terminal of the drive transistor is connected to the second power supply voltage line via the display element, and a control terminal of the drive transistor is connected to the corresponding branch wire via the holding capacitor, and the image data correction step includes a current estimation step of obtaining an estimated value of a current that flows in a branch wire corresponding to any one of the plurality pixel circuits when a data voltage is written in the any one pixel circuit, and a driving data generation step of determining a voltage drop at a connection point between the branch wire and the any one pixel circuit based on the estimated value of the current and correcting image data for the any one pixel circuit in the input image data in accordance with the voltage drop, so as to generate image data corresponding to a data voltage to be written in the any one pixel circuit out of the driving image data.

Effects of the Disclosure

In some of the embodiments of the disclosure, the image data for each pixel circuit out of the input image data is corrected in accordance with a voltage drop occurring at a connection point between the pixel circuit and the branch wire due to a current flowing in the branch wire of the first power supply voltage line (in the data write period) at the time of writing the data voltage in the pixel circuit, and the plurality of data signal lines are driven based on the driving image data made of the corrected image data. Thus, even when a voltage drop has occurred at one terminal of the holding capacitor in the pixel circuit corresponding to the connection point between the branch wire and each pixel circuit, the data voltage corresponding to the original image data corresponding to the pixel circuit is held in the holding capacitor in the data write period. Thereby, a decrease in display luminance due to a voltage drop caused by a current flowing in each branch wire of the first power supply voltage line is prevented, so that a decrease in display quality due to a luminance gradient or the like can be avoided. Further, in some of the embodiments described above, the image data correction unit performs correction corresponding to the voltage drop caused by the current flowing in the branch wire, and the configuration of the circuit (data signal line drive circuit, scanning signal line drive circuit, etc.) for driving the pixel circuit is the same as in the known art, so that it is not necessary to use a driving method for reducing the ratio of the emission period. Therefore, according to the embodiments described above, it is possible to avoid the decrease in display quality due to the luminance gradient or the like caused by the voltage drop while preventing the increase in circuit necessary for driving the pixel circuit, without lowering the ratio of the emission period.

DESCRIPTION OF EMBODIMENTS

Hereinafter, each embodiment will be described with reference to the accompanying drawings. In each of transistors to be mentioned below, a gate terminal corresponds to a control terminal, one of a drain terminal and a source terminal corresponds to a first conductive terminal, and the other corresponds to a second conductive terminal. The description will be given assuming that all the transistors in the embodiments are P-channel type, but the disclosure is not limited thereto. The transistor in each embodiment is, for example, a thin-film transistor, but the disclosure is not limited thereto. Further, "connection" in the present specification means "electrical connection" unless otherwise specified, and includes not only the case of meaning direct connection but also the case of meaning indirect connection via another element in the scope not deviating from the gist of the disclosure.

1. First Embodiment

<1.1 Overall Configuration>

Figure 1:
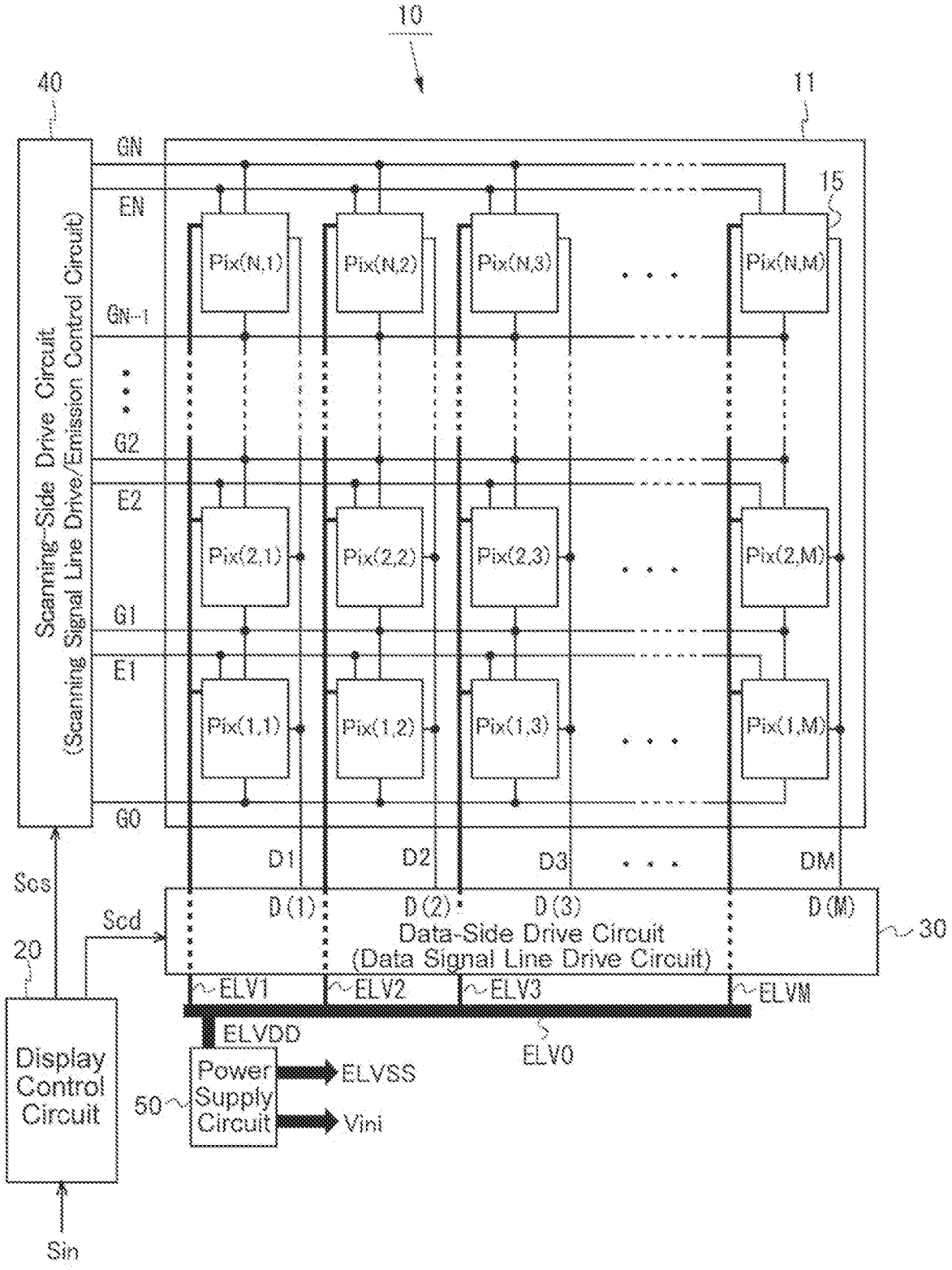
FIG. 1 is a block diagram illustrating the overall configuration of a display device according to a first embodiment.

FIG. 1 is a block diagram illustrating the overall configuration of an organic EL display device 10 according to a first embodiment. The display device 10 is an organic EL display device that performs internal compensation. That is, in the display device 10, at the time of writing pixel data in each pixel circuit, a holding capacitor is charged with a voltage of a data signal (data voltage) via a drive transistor in a diode-connected state in the pixel circuit, thereby compensating for variations and shifts in the threshold voltage of the drive transistor (details will be described later).

As illustrated in FIG. 1, the display device 10 includes a display portion 11, a display control circuit 20, a data-side drive circuit 30, a scanning-side drive circuit 40, and a power supply circuit 50. The data-side drive circuit functions as a data signal line drive circuit (also called "data driver"). The scanning-side drive circuit 40 functions as a scanning signal line drive circuit (also called "gate driver") and an emission control circuit (also called "emission driver"). In the configuration illustrated in FIG. 1, these two drive circuits have been achieved as one scanning-side drive circuit 40, but the two drive circuits in the scanning-side drive circuit 40 may be separated as appropriate, or the two drive circuits may be separated and disposed on one side and the other side of the display portion 11. At least a part of the scanning-side drive circuit and the data-side drive circuit may be formed integrally with the display portion 11. These points are the same in other embodiments and modifications to be described later. The power supply circuit 50 generates a high-level power supply voltage ELVDD, a low-level power supply voltage ELVSS, and an initialization voltage Vini to be supplied to the display portion 11, which will be described later, and a power supply voltage (not illustrated) to be supplied to the display control circuit 20, the data-side drive circuit 30, and the scanning-side drive circuit 40.

In the display portion 11, M (M is an integer equal to or greater than 2) data signal lines D1 to DM and N+1 (N is an integer equal to or greater than 2) scanning signal lines G0 to GN intersecting the data signal lines D1 to DM are arranged, and N emission control lines (also called "emission line") E1 to EN are arranged along the N scanning signal lines G1 to GN, respectively. As illustrated in FIG. 1, the display portion 11 is provided with M×N pixel circuits 15, the M×N pixel circuits 15 are arranged in a matrix form along the M data signal lines D1 to DM and the N scanning signal lines G1 to GN, and each pixel circuit 15 corresponds to any one of the M data signal lines D1 to DM and to any one of the N scanning signal lines G1 to GN (hereinafter, in the case of distinguishing each pixel circuit 15, a pixel circuit corresponding to an ith scanning signal line Gi and a jth data signal line Dj will be referred to as a "pixel circuit on the ith row and the jth column" and denoted by symbol "Pix(i,j)"). The N emission control lines E1 to EN correspond to the N scanning signal lines G1 to GN, respectively. Thus, each pixel circuit 15 corresponds to any one of the N emission control lines E1 to EN.

In the display portion 11, a power supply line common to each pixel circuit 15 is disposed. That is, there are provided a power supply line configured to supply the high-level power supply voltage ELVDD for driving the organic EL element (hereinafter, the line will be referred to as "high-level power supply line" and denoted by the same symbol "ELVDD" as the high-level power supply voltage) and a power supply line (not illustrated) configured to supply a low-level power supply voltage ELVSS for driving the organic EL element (hereinafter, the line will be referred to as "low-level power supply line" and denoted by the same symbol "ELVSS" as the low-level power supply voltage). As illustrated in FIG. 1, the high-level power supply line ELVDD includes a trunk wire ELV0 and M branch wires ELV1 to ELVM diverging from the trunk wire ELV0 and arranged along the plurality of data signal lines D1 to DM, respectively, and each pixel circuit 15 corresponds to any one of the M branch wires ELV1 to ELVM. The display portion 11 is also provided with an initialization voltage supply line (not illustrated) (denoted by symbol "Vini", the same as the initialization voltage) for supplying the initialization voltage Vini to be used for a reset operation for initializing the pixel circuits 15 (details will be described later). The high-level power supply voltage ELVDD, the low-level power supply voltage ELVSS, and the initialization voltage Vini are supplied from the power supply circuit 50.

The display control circuit 20 receives an input signal Sin including image information representing an image to be displayed and timing control information for image display from the outside of the display device 10, generates a data-side control signal Scd and a scanning-side control signal Scs based on the input signal Sin, and outputs the data-side control signal Scd and the scanning-side control signal Scs to the data-side drive circuit (data signal line drive circuit) 30 and the scanning-side drive circuit (scanning signal line drive/emission control circuit) 40, respectively.

The data-side drive circuit 30 drives the data signal lines D1 to DM based on the data-side control signal Scd from the display control circuit 20. That is, based on the data-side control signal Scd, the data-side drive circuit 30 outputs M data signals D(1) to D(M) representing an image to be displayed in parallel and applies the data signals to the data signal lines D1 to DM, respectively.

The scanning-side drive circuit 40 functions as the scanning signal line drive circuit for driving the scanning signal lines G0 to GN and the emission control circuit for driving the emission control lines E1 to EN based on the scanning-side control signal Scs from the display control circuit 20. More specifically, as the scanning signal line drive circuit, based on the scanning-side control signal Scs, the scanning-side drive circuit 40 sequentially selects the scanning signal lines G0 to GM in each frame period, applies an active signal (low-level voltage) to a selected scanning signal line Gk, and applies an inactive signal (high-level voltage) to the non-selected scanning signal line. Thus, M pixel circuits Pix(n,1) to Pix(n,M) corresponding to the selected scanning signal lines Gn ($1 \leq n \leq N$) are selected collectively. As a result, in the selection period for the scanning signal line Gn (hereinafter referred to as "nth scanning selection period"), the voltages (hereinafter, these voltages may be referred to simply as "data voltage" without distinction) of the M data signals D(1) to D(M) applied from the data-side drive circuit 30 to the data signal lines D1 to DM are written as pixel data to the pixel circuits Pix(n,1) to Pix(n,M), respectively. In the following description, it is assumed that the scanning signal lines G0 to GN are selected in ascending order.

Further, as the emission control circuit, based on the scanning-side control signal Scs, the scanning-side drive circuit 40 applies an emission control signal (high-level voltage) indicating non-emission to an ith emission control line Ei in an (i−1)th horizontal period and an ith horizontal period and applies an emission control signal (low-level voltage) indicating light emission in the other periods. While the voltage of the emission control line Ei is at a low level, that is, while the emission control line Ei is in an active state, the organic EL elements in the pixel circuits (hereinafter also referred to as "pixel circuits on the ith row") Pix(i,1) to Pix(i,M) corresponding to the ith scanning signal line Gi emit light with a luminance corresponding to the data voltages written respectively in the pixel circuits Pix(i,1) to Pix(i,M) on the ith row.

<1.2 Configuration and Operation of Pixel Circuit>

Figure 2:
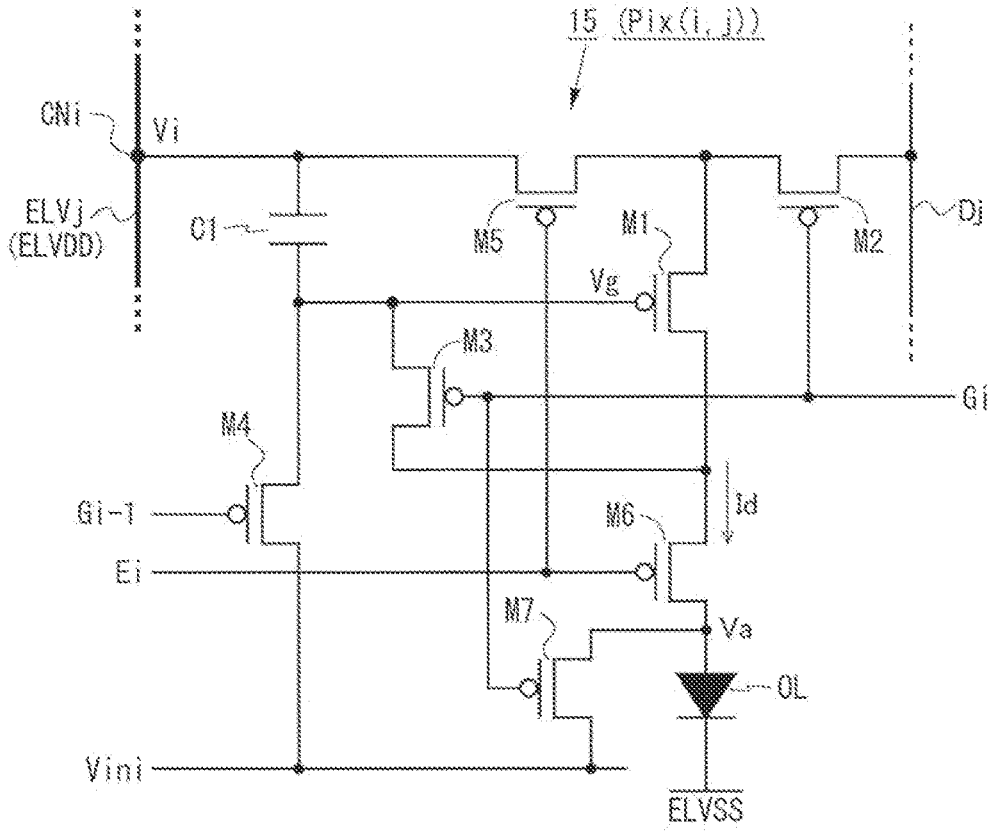
FIG. 2 is a circuit diagram illustrating the configuration of a pixel circuit in the first embodiment.

FIG. 2 is a circuit diagram illustrating the configuration of the pixel circuit 15 in the present embodiment, and more specifically, a circuit diagram illustrating the configuration of the pixel circuit 15 corresponding to the ith scanning signal line Gi and the jth data signal line Dj, that is, the pixel circuit Pix(i,j) on the ith row and the jth column ($1 \leq i \leq N$, $1 \leq j \leq M$). As illustrated in FIG. 2, the pixel circuit 15 includes an organic EL element OL as a display element, a drive transistor M1, a write control transistor M2, a threshold compensation transistor M3, a first initialization transistor M4, a first emission control transistor M5, a second emission control transistor M6, a second initialization transistor M7, and a holding capacitor C1. In the pixel circuit 15, the transistors M2 to M7 other than the drive transistor M1 function as switching elements.

To the pixel circuit 15, there are connected a scanning signal line (hereinafter also referred to as "corresponding scanning signal line" in the description focusing on the pixel circuit) Gi corresponding to the pixel circuit 15, a scanning signal line (a scanning signal line immediately before in the scanning order of the scanning signal lines G1 to GN, hereinafter also referred to as "preceding scanning signal line" in the description focusing on the pixel circuit) Gi−1 immediately before the corresponding scanning signal line Gi, an emission control line (hereinafter also referred to as "corresponding emission control line" in the description focusing on the pixel circuit) Ei corresponding to the pixel circuit 15, a data signal line (hereinafter also referred to as "corresponding data signal line" in the description focusing on the pixel circuit) Dj corresponding to the pixel circuit 15, the initialization voltage supply line Vini, the high-level power supply line ELVDD, and the low-level power supply line ELVSS. Here, the high-level power supply line ELVDD connected to the pixel circuit 15 is, more specifically, a branch wire (hereinafter also referred to as "corresponding branch wire" in the description focusing on the pixel circuit) ELVj corresponding to the pixel circuit 15 out of the M branch wires ELV1 to ELVM included in the high-level power supply line ELVDD. Thus, the pixel circuit Pix(i,j) on the ith row and the jth column is supplied with the high-level power supply voltage ELVDD from the power supply circuit 50 via the trunk wire ELV0 and the corresponding branch wire ELVj in this order.

As illustrated in FIG. 2, in the pixel circuit 15, the source terminal as the first conductive terminal of the drive transistor M1 is connected to the corresponding data signal line Dj via the write control transistor M2 and is connected to the high-level power supply line ELVDD (more specifically, the corresponding branch wire ELVj) via the first emission control transistor M5. The drain terminal as the second conductive terminal of the drive transistor M1 is connected to an anode electrode of the organic EL element OL via the second emission control transistor M6. The gate terminal serving as the control terminal of the drive transistor M1 is connected to the high-level power supply line ELVDD (corresponding branch wire ELVj) via the holding capacitor C1, is connected to the drain terminal of the drive transistor M1 via the threshold compensation transistor M3, and is connected to the initialization voltage supply line Vini via the first initialization transistor M4. The anode electrode of the organic EL element OL is connected to the initialization voltage supply line Vini via the second initialization transistor M7, and a cathode electrode of the organic EL element OL is connected to the low-level power supply line ELVSS. The gate terminals of the write control transistor M2, the threshold compensation transistor M3, and the second initialization transistor M7 are connected to the corresponding scanning signal line Gi, the gate terminals of the first and second emission control transistors M5, M6 are connected to the corresponding emission control line Ei, and the gate terminal of the first initialization transistor M4 is connected to the preceding scanning signal line Gi−1.

The drive transistor M1 operates in a saturation region, and a drive current Id flowing through the organic EL element OL in the emission period is given by Equation (1) below: A gain β of the drive transistor M1 included in Equation (1) is given by Equation (2) below:

$$Id = (\beta/2)(|Vgs| - |Vth|)^2 = (\beta/2)(|Vg - ELVDD| - |Vth|)^2 \quad (1)$$

$$\beta = \mu \times (W/L) \times Cox \quad (2)$$

In Equations (1) and (2) above, Vth, μ, W, L, and Cox represent the threshold voltage, mobility, gate width, gate length, and gate insulating film capacitance per unit area of the drive transistor M1, respectively.

Figure 3:
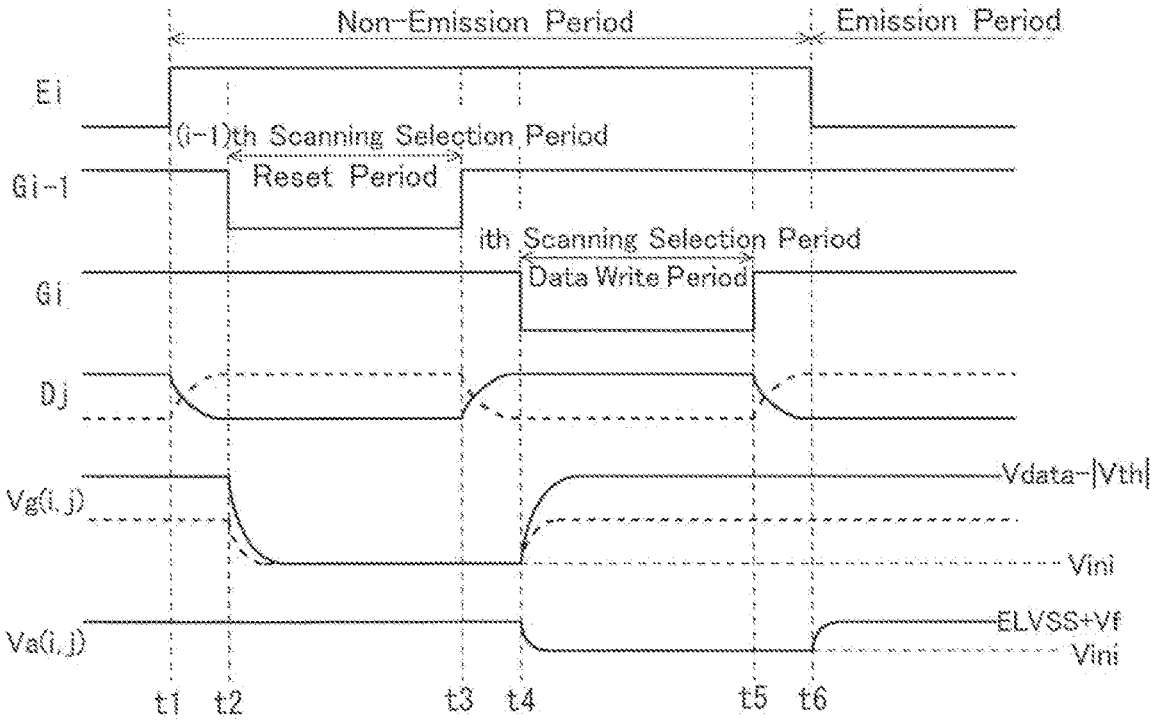
FIG. 3 is a signal waveform diagram for describing the driving of the display device according to the first embodiment.

FIG. 3 is a signal waveform diagram for describing the driving of the display device according to the present embodiment and illustrates changes in the voltage of each signal line (corresponding emission control line Ei, preceding scanning signal line Gi−1, corresponding scanning signal line Gi, and corresponding data signal line Dj), the voltage (hereinafter referred to as "gate voltage") Vg of the gate terminal of the drive transistor M1, and the voltage (hereinafter referred to as "anode voltage") Va of the anode electrode of the organic EL element OL during the initialization operation, the data write operation, and the emission operation of the pixel circuit 15 illustrated in FIG. 3, that is, the pixel circuit Pix(i,j) on the ith row and the jth column. In FIG. 3, a period from time t1 to time t6 is a non-emission period for the pixel circuits Pix(i,1) to Pix(i,M) on the ith row. A period from time t2 to time t4 is the (i−1)th horizontal period, and a period from time t2 to time t3 is a selection period for the (i−1)th scanning signal line (preceding scanning signal line) Gi−1 (hereinafter referred to as "(i−1)th scanning selection period"). The (i−1)th scanning selection period corresponds to a reset period for the pixel circuits Pix(i,1) to Pix(i,M) on the ith row. A period from time t4 to time t6 is the ith horizontal period, and a period from time t4 to time t5 is a selection period for the ith scanning signal line (corresponding scanning signal line) Gi (hereinafter referred to as "ith scanning selection period"). The ith scanning selection period corresponds to a data write period for the pixel circuits Pix(i,1) to Pix(i,M) on the ith row.

In the pixel circuit Pix(i,j) on the ith row and the jth column, when the voltage of the emission control line Ei changes from the low level to the high level at time t1 as illustrated in FIG. 3, the first and second emission control transistors M5, M6 change from the on-state to the off-state, and the organic EL element OL comes into a non-emission state. During the period from time t1 to the start time t2 of the (i−1)th scanning selection period, the data-side drive circuit 30 starts to apply a data signal D(j) as the data voltage of the pixel on the (i−1)th row and jth column to the data signal line Dj, but in the pixel circuit Pix(i,j), the write control transistor M2 connected to the data signal line Dj is in the off-state.

At time t2, the voltage of the preceding scanning signal line Gi−1 changes from the high level to the low level, so that the preceding scanning signal line Gi−1 comes into a selected state. Hence, the first initialization transistor M4 changes to the on-state. Thereby, the voltage at the gate terminal of the drive transistor M1, that is, the gate voltage Vg, is initialized to be the initialization voltage Vini. The initialization voltage Vini is such a voltage that the drive transistor M1 can be maintained in the on-state at the time of writing the data voltage in the pixel circuit Pix(i,j). More specifically, the initialization voltage Vini satisfies Equation (3) below:

$$|Vini - V\text{data}| > |Vth| \quad (3)$$

Here, Vdata is a data voltage (a voltage of the corresponding data signal line Dj), and Vth is a threshold voltage of the drive transistor M1. Further, since the drive transistor M1 in the present embodiment is of the P-channel type, $$Vini < V\text{data} \quad (4).$$

By the initialization of the gate voltage Vg with the initialization voltage Vini as thus described, it is possible to reliably write the data voltage in the pixel circuit Pix(i,j). Note that the initialization of the gate voltage Vg is also the initialization of the holding voltage of the holding capacitor C1.

The period from time t2 to time t3 is a reset period in the pixel circuits Pix(i,1) to Pix(i,M) on the ith row, and in the pixel circuit Pix(i,j), the gate voltage Vg is initialized by the first initialization transistor M4 being on the on-state as described above in the reset period. FIG. 3 illustrates a change in the gate voltage Vg(i,j) of the pixel circuit Pix(i,j) at this time. Note that symbol "Vg(i,j)" is used in a case where the gate voltage Vg in the pixel circuit Pix(i,j) is distinguished from the gate voltage Vg in another pixel circuit (the same shall apply hereinafter).

At time t3, the voltage of the preceding scanning signal line Gi−1 changes to the high level, so that the preceding scanning signal line Gi−1 comes into an unselected state. Hence the first initialization transistor M4 changes to the off-state. During the period from time t3 to the start time t4 of the ith scanning selection period, the data-side drive circuit 30 starts to apply the data signal D(j) as the data voltage of the pixel on the ith row and jth column to the data signal line Dj and continues to apply the data signal D(j) at least until the end time t5 of the ith scanning selection period.

At time t4, the voltage of the corresponding scanning signal line Gi changes from the high level to the low level, so that the corresponding scanning signal line Gi comes into the selected state. Hence, the write control transistor M2 changes to the on-state. With the threshold compensation transistor M3 also changing to the on-state, the drive transistor M1 comes into a state where its gate terminal and drain terminal are connected, that is, in a diode-connected state. Thereby, the voltage of the corresponding data signal line Dj, that is, the voltage of the data signal D(j), is supplied as the data voltage Vdata to the holding capacitor C1 via the drive transistor M1 in the diode-connected state. As a result, as illustrated in FIG. 3, the gate voltage Vg(i,j) changes toward a value given by Equation (5) below.

$$Vg(i,j) = V\text{data} - |Vth| \quad (5)$$

At time t4, the voltage of the corresponding scanning signal line Gi changes from the high level to the low level, so that the second initialization transistor M7 also changes to the on-state. As a result, a charge accumulated in the parasitic capacitance of the organic EL element OL is released, and the anode voltage Va of the organic EL element is initialized to the initialization voltage Vini (see FIG. 3). Note that symbol "Va(i,j)" is used in a case where the anode voltage Va in the pixel circuit Pix(i,j) is distinguished from the anode voltage Va in another pixel circuit (the same shall apply hereinafter).

The period from time t4 to time t5 is a data write period in the pixel circuits Pix(i,1) to Pix(i,M) on the ith row, and in the pixel circuit Pix(i,j), in this data write period, the data voltage subjected to threshold compensation as described above is written in the holding capacitor C1, and the gate voltage Vg(i,j) becomes a value given by Equation (5) above.

Thereafter, at time t6, the voltage of the emission control line Ei changes to the low level. Accordingly, the first and second emission control transistors M5, M6 change to the on-state. Therefore, after time t6, a current Id flows from the corresponding branch wire ELVj of the high-level power supply line ELVDD to the low-level power supply line ELVSS via the first emission control transistor M5, the drive transistor M1, the second emission control transistor M6, and the organic EL element OL. The current Id is given by Equation (1) above. Considering that the drive transistor M1 is of the P-channel type and ELVDD>Vg, the current Id is given by the following equation from Equations (1) and (5) above.

$$Id = (\beta/2)(ELVDD - Vg - |Vth|)^2 = (\beta/2)(ELVDD - Vdata)^2 \quad (6)$$

As described above, after time t6, the organic EL element OL emits light with a luminance corresponding to the data voltage Vdata, which is the voltage of the corresponding data signal line Dj in the ith scanning selection period, regardless of the threshold voltage Vth of the drive transistor M1.

<1.3 Configuration and Operation for Generating Driving Image Data Signals>

As illustrated in FIG. 2, in the pixel circuit 15 of the present embodiment, the gate terminal of the drive transistor M1 is connected to the corresponding branch wire ELVj of the high-level power supply line ELVDD via the holding capacitor C1, the source terminal of the drive transistor M1 is connected to the corresponding branch wire ELVj of the high-level power supply line ELVDD via the first emission control transistor M5, and the first emission control transistor M5 is in the on-state in the emission period. In such a pixel circuit 15, the current Id corresponding to the difference between the voltage applied from the corresponding data signal line Dj to one end of the holding capacitor C1 and the voltage of the corresponding branch wire ELVj connected to the other end of the holding capacitor C1 in the ith scanning selection period in the non-emission period flows through the organic EL element OL in the emission period. In the above, it has been described that the current Id is given by Equation (6). In this Equation (6), it is assumed that the voltage at the other end of the holding capacitor C1, that is, the voltage of the corresponding branch wire ELVj, in the ith scanning selection period in the data write period, that is, the non-emission period, is equal to the high-level power supply voltage ELVDD.

However, with each pixel circuit 15 being driven as illustrated in FIG. 3, in the ith scanning selection period which is the data write period for the pixel circuit Pix(i,j) on the ith row and the jth column, the pixel circuit 15 connected to the corresponding branch wire ELVj, that is, the pixel circuit Pix(i,j) on the ith row and the pixel circuit Pix(i+1,j) on the (i+1)th row out of the pixel circuits Pix(1,j) to Pix(N,j) on the jth column, are in the non-emission state, while the pixel circuits Pix(1,j) to Pix(i−1,j), Pix(i+2,j) to Pix(N,j) other than the above circuits are in the emission state. Thus, in the data write period for the pixel circuit Pix(i,j) on the ith row and the jth column, a voltage drop occurs in the corresponding branch wire ELVj in accordance with the currents flowing in the pixel circuits Pix(1,j) to Pix(i−1,j), Pix(i+2,j) to Pix(N,j) in the emission state, respectively. As a result, when the voltage of the connection point CNi (hereinafter also referred to simply as "ith connection point CNi") of the pixel circuit Pix(i,j) on the ith row and the jth column in the corresponding branch wire ELVj in the data write period is denoted by symbol "V(i,j)", the voltage (hereinafter referred to as "capacitor holding voltage") Vc1 with which the holding capacitor C1 of the pixel circuit Pix(i,j) is charged in the data write period is Vc1=V(i,j)−(Vdata−|Vth|).

The capacitor holding voltage Vc1 corresponds to the absolute value |Vgs| of the gate-source voltage of the drive transistor M1 in the data write period and maintains the value also in the emission period immediately after the data write period. Thus, a current $i_j$ flowing through the organic EL element OL of the pixel circuit Pix(i,j) on the ith row and the jth column in the emission period immediately after the data write period is given by Equation (7) below:

$$i_j = Id = (\beta/2)(V(i, j) - Vdata)^2 \quad (7)$$

V(i,j) in Equation (7) above is a value smaller than the high-level power supply voltage ELVDD by a voltage drop (hereinafter also referred to as "a voltage drop at the connection point CNi") ΔV(i,j) in the path from the power supply circuit 50 to the ith connection point CNi in a corresponding branch wire ELVk. In the present embodiment, driving image data is generated by correcting input image data representing an image to be displayed so as to compensate for the voltage drop ΔV(i,j), and a data signal to be applied to the data signal lines D1 to DM is generated based on the driving image data.

Figure 4:
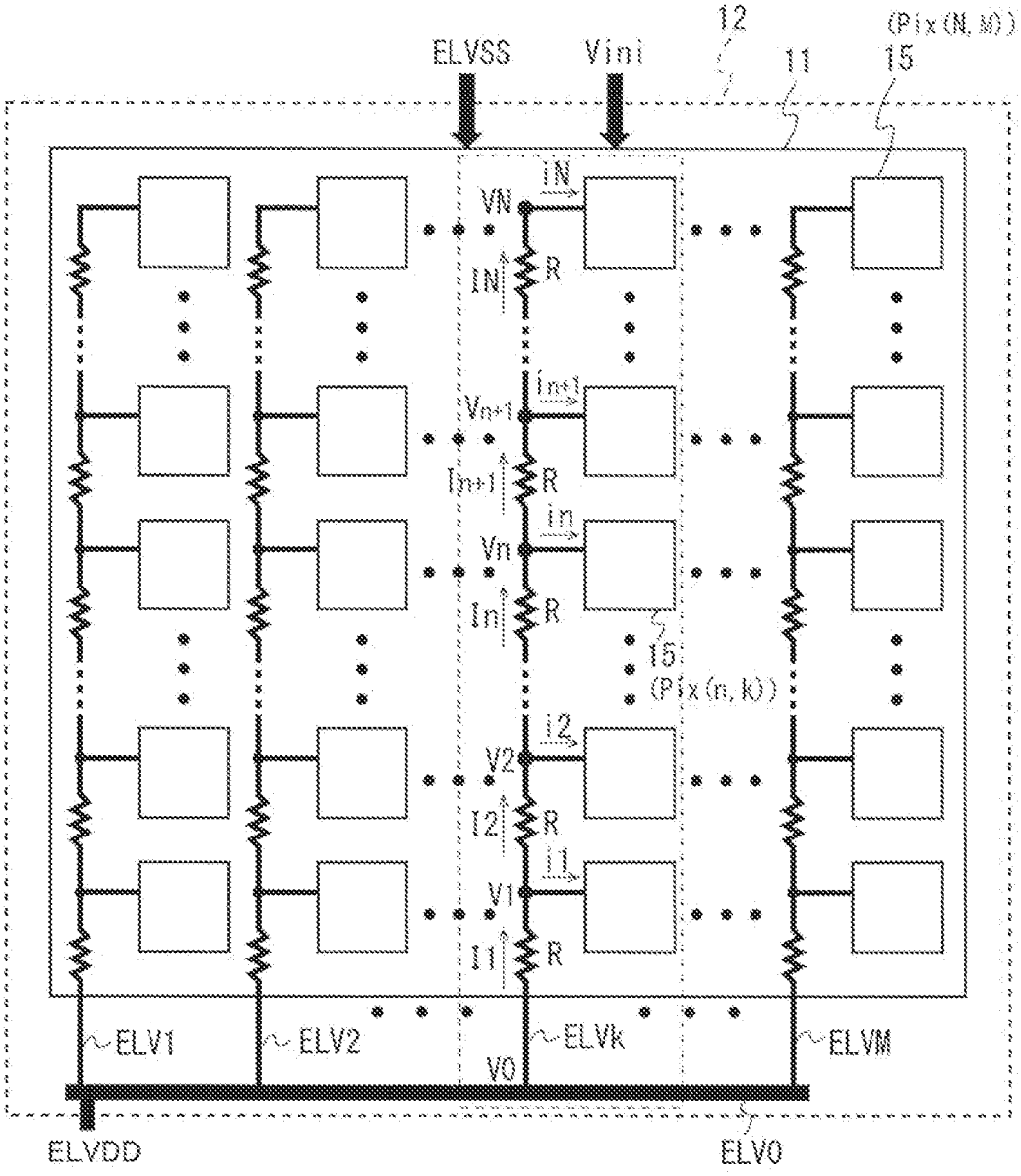
FIG. 4 is a circuit diagram for describing a method of calculating a voltage drop in power supply wiring of a display portion in the first embodiment.

For generating such driving image data, it is necessary to determine the voltage drop ΔV(i,j) on the high-level power supply line ELVDD of the display portion 11 in the present embodiment. FIG. 4 is a circuit diagram for describing a calculation technique for the voltage drop ΔV(i,j) on the high-level power supply line ELVDD of the display portion 11 in the present embodiment. Hereinafter, with attention paid to the kth branch wire (also referred to as a "branch wire on the kth column") ELVk corresponding to the pixel circuits Pix(1,k) to Pix(N,k) on the kth column of the high-level power supply line ELVDD, a calculation method for the voltage V(i,k) (=ELVDD−ΔV(i,k)) and the voltage drop ΔV(i,k) at the connection point CNi with each pixel circuit Pix(i,k) on the branch wire ELVk will be described with reference to FIGS. 1 and 4.

As illustrated in FIGS. 1 and 4, in the present embodiment, the high-level power supply line ELVDD has a comb-shaped structure and includes the trunk wire ELV0 disposed in one picture-frame region along the scanning signal lines G0 to GN among the picture-frame regions adjacent to the display region in the display panel 12 including the display portion 11, and the M branch wires ELV1 to ELVM diverging from the trunk wire ELV0 and arranged along the M data signal lines D1 to DM, respectively. To the kth data signal line Dk and the kth branch wire ELVk, the pixel circuits Pix(1,k) to Pix(N,k) on the kth column are connected. Each of the branch wires ELV1 to ELVM contains a resistance component, and in the following description, the resistance and its value of the wiring portion of one branch wire ELVk between the two pixel circuits Pix(i,k), Pix(i+1,k) connected to the branch wires ELVk and adjacent to each other (the wiring portion from the ith connection point CNi to the (i+1)th connection point CNi+1 of the branch wire ELVk), are denoted by symbol "R" (i=1 to N−1). In the present embodiment, the resistance in the trunk wire ELV0 is assumed to be negligible, and the resistance and its value of the wiring portion of the high-level power supply line ELVDD from the power supply circuit 50 to the connection point CN1 of the pixel circuit Pix(i,k) on the first row and the kth column are also denoted by symbol "R". Further, it is assumed that the N+1 scanning signal lines G0 to GN are scanned in order (j=0, 1, 2, . . . , N) from the scanning signal line Gi close to the trunk wire ELV0, and therefore, data voltages are written in the pixel circuit Pix(i,j) connected to each branch wire ELVj(j=1 to M) in order close to the trunk wire ELV0.

Now, the operation of the display portion 11 at the time of writing the data voltage in the nth pixel circuit Pix(n,k) of the pixel circuits Pix(1,k) to Pix(N,k) on the kth column is considered (1≤n≤N). At this time, the voltage drop ΔVn (=ΔV(n,k)) occurring at the connection point CNn of the nth pixel circuit Pix(n,k) on the kth branch wire ELVk can be determined as follows. Hereinafter, the current flowing through the organic EL element OL of the pixel circuit Pix(p,k) on the pth row and kth column is denoted by symbol "$i_p$" (p=1 to N), the current flowing in the wiring portion of the kth branch wire ELVk between the connection points CNq and CNq+1 is denoted by symbol "Iq+1" (q=1 to N−1), and the current flowing in the wiring portion between the trunk wire ELV0 and the connection point CN1 is denoted by symbol "I1". Hereinafter, the current Ip (p=1 to N) flowing in the branch wire ELVk will be referred to as the pth power supply line current Ip" or simply the "power supply line current Ip", and the current $i_p$ flowing through the organic EL element OL of the pixel circuit Pix(p,k) will be referred to as the "pth pixel current $i_p$" or simply the "pixel current $i_p$". In a case where the pixel current $i_p$ is distinguished before and after data writing in the pixel circuit Pix(p,k), the pixel current $i_p$ before the data writing is denoted by symbol "$i_p(t)$", and the pixel current $i_p$ after the data writing is denoted by symbol "$i_p(t+1)$" (the values of the pixel currents $i_p(t)$ and $i_p(t+1)$ are also referred to as "immediately-preceding-frame current value" and "present-frame current value", respectively). Further, the ith power supply line current Ii on the kth column in the data write period for the pth pixel circuit Pix(p,k) is demoted by symbol "Ii(p)" (p=1 to N, i=1 to N). As is apparent from FIGS. 2 and 3, the pixel current $i_p$=Id, which is the current flowing through the organic EL element OL of the pixel circuit Pix(p,k) corresponds to the current supplied to the pixel circuit Pix(p,k) from the power supply line (kth branch wire ELVk).

The voltage Vn at the nth connection point CNn at the time of writing the data voltage in the nth pixel circuit Pix(n,k) of the pixel circuits Pix(1,k) to Pix(N,k) on the kth column connected to the kth branch wire ELVk is given by the following equation:

$$Vn = V0 - I1(n)\cdot R - I2(n)\cdot R - \ldots - In(n)\cdot R = V0 - \{I1(n) + I2(n) + \ldots + In(n)\}R \quad (8)$$

In the above equation, V0 represents the high-level power supply voltage ELVDD (V0=ELVDD). In the data write period for the nth pixel circuit Pix(n,k), since the emission control line En corresponding to the pixel circuit Pix(n,k) is in an inactive state (since a high-level voltage is being applied to the emission control line En,), in the pixel circuit Pix(n,k), the supply of the current from the high-level power supply line ELVDD is cut off by the first emission control transistor M5, and the supply of the current from the drive transistor M1 to the organic EL element OL is cut off by the second emission control transistor M6 (see FIGS. 2 and 3). Therefore, the pixel circuit Pix(n,k) is not supplied with a current from the power supply line (the branch wire ELVk of the high-level power supply line ELVDD) ($i_n$=0) and is in the non-emission state. The data write period in the nth pixel circuit Pix(n,k) corresponds to a reset period in the (n+1)th pixel circuit Pix(n+1,k) (see FIG. 3). Therefore, in the data write period for the nth pixel circuit Pix(n,k), the (n+1)th pixel circuit Pix(n+1,k) is not supplied with a current from the power supply line (the branch wire ELVk of the high-level power supply line ELVDD), either ($i_{n+1}$=0). Therefore, the following is obtained:

$$I1(n) = i_1(t+1) + i_2(t+1) + \ldots + i_{n-1}(t+1) + i_{n+2}(t) + \ldots + i_N(t) \ \ldots \ (9_1)$$

$$I2(n) = i_2(t+1) + i_3(t+1) + \ldots + i_{n-1}(t+1) + i_{n+2}(t) + \ldots + i_N(t) \ \ldots \ (9_2)$$

$$\ldots$$

$$In-1(n) = i_{n-1}(t+1) + i_{n+2}(t) + \ldots + i_N(t) \ \ldots \ (9_n-1)$$

$$In(n) = i_{n+2}(t) + \ldots + i_N(t) \ \ldots \ (9_n)$$

As above, the power supply line current Ip(n) includes only the current supplied from the power supply line to the pixel circuits Pix(1,k) to Pix(n−1,k), Pix(n+2,k) to Pix(N,k) in the emission state out of the pixel circuits Pix(1,k) to Pix(N,k) connected to the kth branch wire ELVk (p=1 to N). Note that the pixel circuit Pix(p,k) in the emission state is a pixel circuit in which the voltage of the corresponding emission control line Ep is at the low level, that is, a pixel circuit in which the corresponding emission control line Ep is in the active state.

On the other hand, the voltage Vn+1 at the (n+1)th connection point CNn+1 in the data write period for the pixel circuit Pix(n+1,k) in which the data voltage is written next to the nth pixel circuit Pix(n,k) out of the pixel circuits Pix(1,k) to Pix(N,k) on the kth column is given by the following equation (1≤n≤N−1):

$$Vn+1 = V0 - \{I1(n+1) + I2(n+1) + \ldots + In+1(n+1)\}R \quad (10)$$

In the data write period for the (n+1)th pixel circuit Pix(n+1,k) ((n+1)th scanning selection period), no current is supplied from the power supply line to the pixel circuit Pix(n+1,k) ($i_{n+1}$=0), and the current $i_n(t+1)$ corresponding to the data voltage written in the data write period (nth scanning selection period) is supplied from the power supply line to the nth pixel circuit Pix(n,k). The data write period in the (n+1)th pixel circuit Pix(n+1,k) corresponds to the reset period in the (n+2)th pixel circuit Pix(n+2,k) (1≤n≤N−2), and hence the current is not supplied to the (n+2)th second pixel circuit Pix(n+2,k) from the power supply line, either ($i_{n+2}$=0). Therefore, the following is obtained:

$$I1(n+1) = i_1(t+1) + i_2(t+1) + \ldots + i_n(t+1) + i_{n+3}(t) + \ldots + i_N(t) \ \ldots \ (11_1)$$

$$I2(n+1) = i_2(t+1) + i_3(t+1) + \ldots + i_n(t+1) + i_{n+3}(t) + \ldots + i_N(t) \ \ldots \ (11_2)$$

$$\ldots$$

$$In-1(n+1) = i_{n-1}(t+1) + i_n(t+1) + i_{n+3}(t) + \ldots + i_N(t) \ \ldots \ (11_n-1)$$

$$In(n+1) = i_n(t+1) + i_{n+3}(t) + \ldots + i_N(t) \ \ldots \ (11_n)$$

$$In+1(n+1) = i_{n+3}(t) + \ldots + i_N(t) \ \ldots \ (11_n+1)$$

As above, the power supply line current Ip(n+1) also includes only the current supplied from the power supply line to the pixel circuits Pix(1,k) to Pix(n,k), Pix(n+3,k) to Pix(N,k) in the emission state out of the pixel circuits Pix(1,k) to Pix(N,k) connected to the kth branch wire ELVk (p=1 to N).

Equations (9_1) to (9_n) and (11_1) to (11_n) above are compared, respectively, to obtain the following equation:

$$I1(n+1) = I1(n) + i_n(t+1) - i_{n+2}(t)$$

$$\cdots$$

$$In(n+1) = In(n) + i_n(t+1) - i_{n+2}(t)$$

Considering these equations and Equation (8), Equation (10) can be rewritten as follows:

$$Vn+1 = V0 - \{I1(n) + I2(n) + \ldots In(n) + In+1(n+1) + n \cdot i_n(t+1) - n \cdot i_{n+2}(t)\} R = Vn - \{n \cdot i_n(t+1) - n \cdot i_{n+2}(t) + In+1(n+1)\}R \quad (12)$$

Here, when Equation (9_n) above is compared with Equation (11_N+1), the following is obtained:

$$In+1(n+1)=In(n)-i_{n+2}(t) \quad (13)$$

Equations (12) and (13) above hold for an integer n satisfying $1 \leq n \leq N-1$ ($i_{N+1}(t)=0$). On the other hand, as apparent from FIG. 4, the voltage drop ΔV1 at the connection point CN1 is given by the following equation:

$$V1=V0-I1(1)\cdot R \quad (14)$$

Here, the following is obtained:

$$I1(1)=i_3(t)+i_4(t)+\ldots+i_N(t) \quad (15)$$

Figure 7:
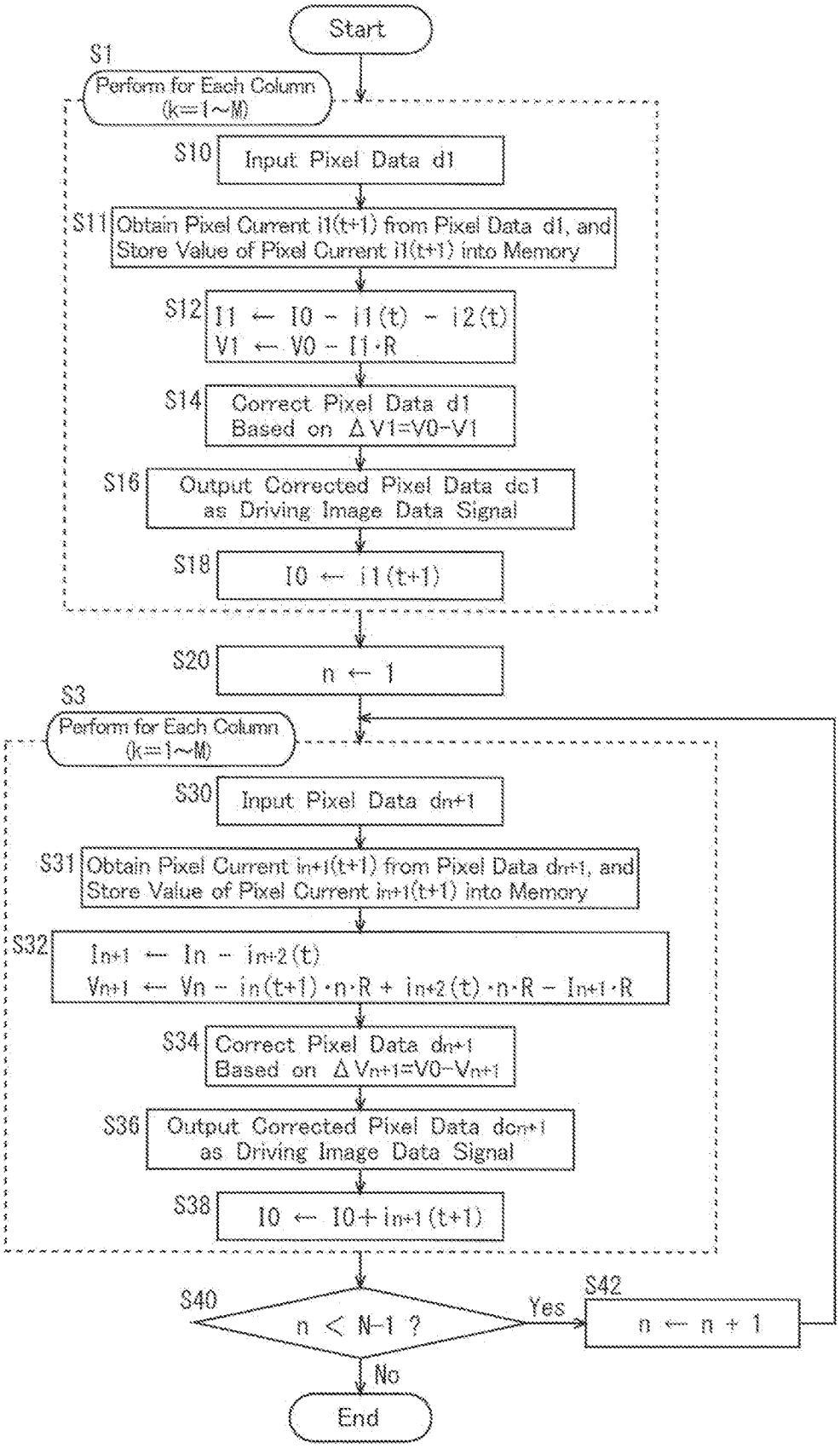
FIG. 7 is a flowchart illustrating the image data correction processing in the first embodiment.

From Equations (12) to (15) above, it can be seen that when the value of the voltage Vp at the connection point CNp with each pixel circuit Pix(p,k) on the kth branch wire ELVk is sequentially obtained from the value at p=1 to the value at p=N, the value of the voltage drop ΔVp=V0−Vp at each connection point CNp can be calculated efficiently. FIG. 7 is a flowchart illustrating the procedure of the image data correction processing with attention paid to this point. In the present embodiment, an image data correction circuit 204 included in the display control circuit 20 is configured as dedicated hardware for performing the image data correction processing. Hereinafter, the display control circuit 20 in the present embodiment configured to perform the image data correction processing will be described below.

Figure 5:
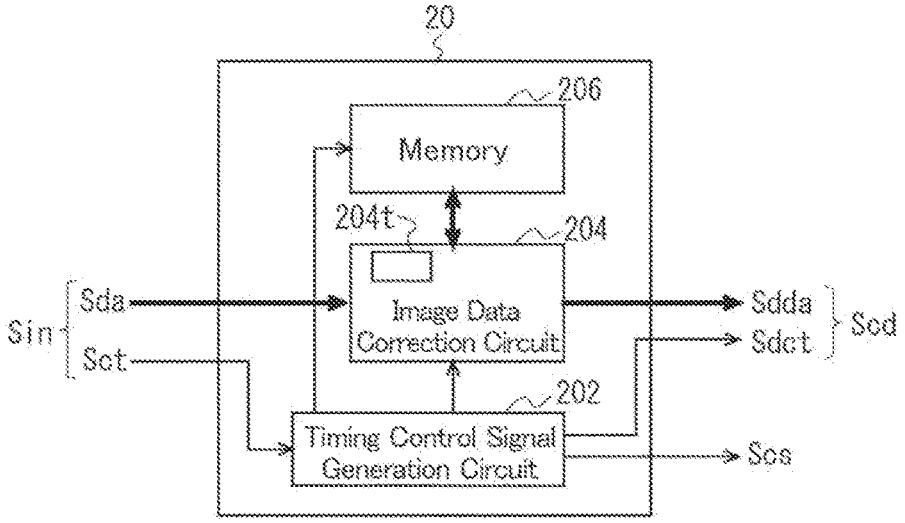
FIG. 5 is a block diagram illustrating the configuration of a display control circuit in the first embodiment.

FIG. 5 is a block diagram illustrating the configuration of the display control circuit 20 in the present embodiment. The display control circuit 20 includes a timing control signal generation circuit 202, the image data correction circuit 204, and a memory 206. The input signal Sin received from the outside by the display control circuit 20 includes an image data signal Sda and a display control signal Sct. The image data signal Sda is input to the image data correction circuit 204, and the display control signal Sct is input to the timing control signal generation circuit 202. The memory 206 has a storage capacity capable of storing the values of the currents flowing in (the organic EL elements OL of) all the pixel circuits Pix(1,1) to Pix(N,m), that is, the values of the currents supplied from the high-level power supply line ELVDD to the pixel circuits Pix(1,1) to Pix(N,m), respectively.

The timing control signal generation circuit 202 generates a data-side timing control signal Sdct and a scanning-side timing control signal Ssct based on the display control signal Sct. The data-side timing control signal Sdct is output from the display control circuit 20 as a part of the data-side control signal Scd. The scanning-side timing control signal Ssct is output from the display control circuit 20 and is input to the scanning-side drive circuit 40 as the scanning-side control signal Scs (see FIG. 1). Note that the timing control signal generation circuit 202 also generates a timing control signal for controlling the operation of the image data correction circuit 204 and the memory 206 based on the display control signal Sct.

The image data correction circuit 204 receives the image data signal Sda as a serial signal for each pixel, applies correction processing sequentially to the pixel data constituting the input image data indicated by the image data signal Sda by using the memory 206, and outputs the corrected pixel data sequentially as a driving image data signal Sdda. The driving image data signal Sdda and the data-side timing control signal Sdct constitute the data-side control signal Scd, and the data-side control signal Scd is output from the display control circuit 20 and input to the data-side drive circuit 30 (see FIG. 1).

Next, the details of the operation of the image data correction circuit 204, that is, the details of the image data correction processing for generating driving image data, will be described with reference to FIGS. 4 to 7.

Figure 6:
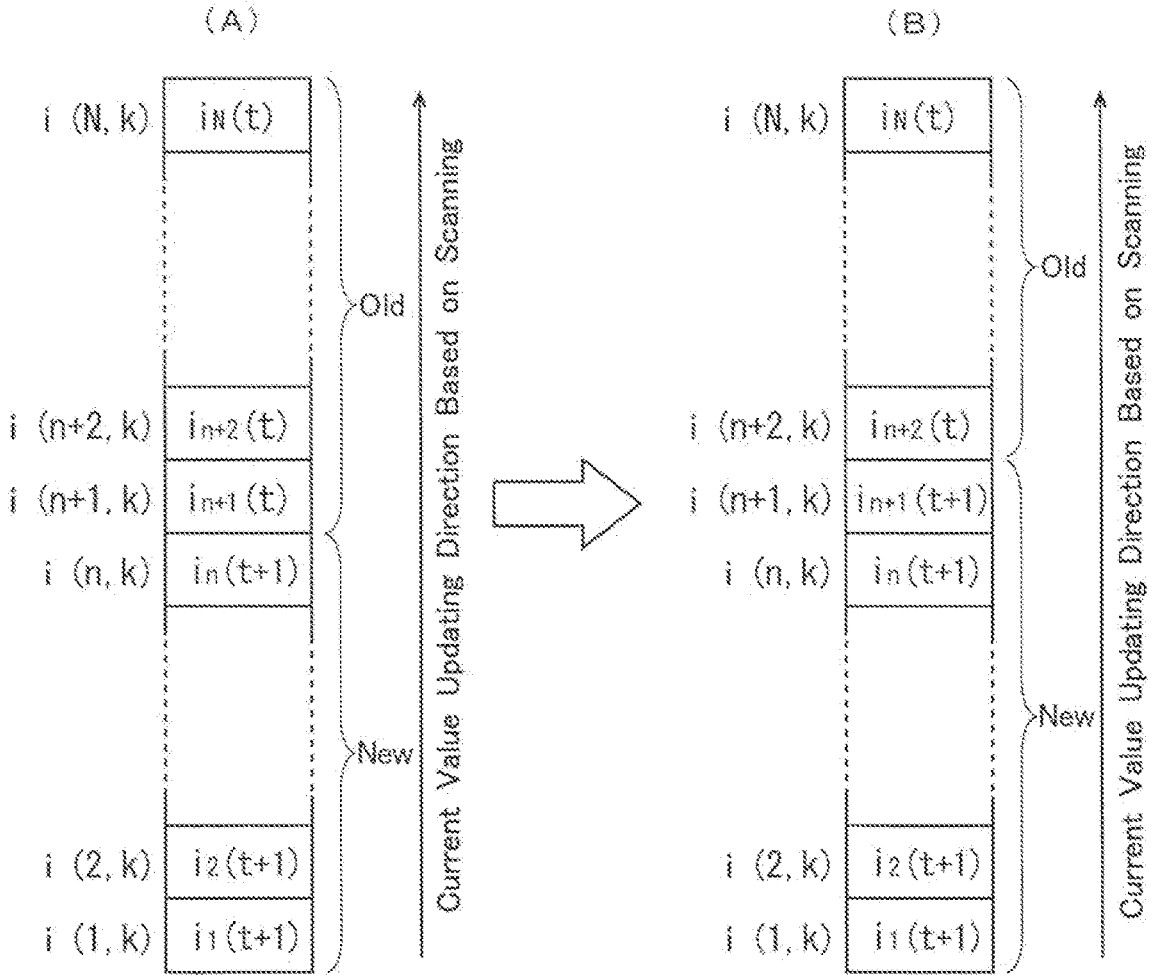
FIG. 6 provides diagrams (A) and (B) for describing the storage of a current value into a memory for image data correction processing that is performed in the first embodiment.

In the present embodiment, the image data correction processing illustrated in FIG. 7 is performed each time the display image of one frame is refreshed (each time image data for one frame is rewritten in the display portion 11). FIG. 6 is a diagram for describing the storage of the current value in the memory 206 for the image data correction processing.

In the image data correction processing, when the input of the image data signal Sda indicating new input image data is started, the image data correction circuit 204 operates as follows. In the following description, it is assumed that at the start time of the image data correction processing, the value of the pixel current i(n,j) in each pixel circuit Pix (n,j) (n=1 to N, j=1 to M) (n,j) is stored in the memory 206 by image data arithmetic processing for the immediately preceding frame (details will be described later). It is assumed that the display luminance of each pixel circuit Pix(n,j) is determined by the pixel current i(n,j) of the pixel circuit Pix(n,j) that is, the drive current Id flowing through the organic EL element OL of the pixel circuit Pix(n,j), and the image data correction circuit 204 includes a conversion table 204*t* configured to convert the pixel data d(n,j) indicating the display luminance of the pixel circuit Pix(n,j) into the pixel current i(n,j) when the pixel circuit Pix(n,j) emits light with the display luminance. The conversion table 204*t* provides, based on the pixel data constituting the input image data, an estimated value of the pixel current i(n,j) (hereinafter simply referred to as the "value of the pixel current i(n,j)") corresponding to the drive current Id in each pixel circuit Pix(i,j), but instead of the conversion table 204*t*, a predetermined mathematical formula or function may be used to calculate the value of the corresponding pixel current i(n,j) from the pixel data in the image data. As described above, the pixel current i(n,j) is a current flowing through the organic EL element OL of the pixel circuit Pix(n,j) and corresponds to a current supplied to the pixel circuit Pix(n,j) from the power supply line (jth branch wire ELVj) (see FIGS. 2 and 3).

Hereinafter, in a case where the processing is described with attention paid to the pixel circuits on one column, for example, the pixel circuits Pix(1,k) to Pix(N,k) on the kth column, the pixel current i(n,k) of each pixel circuit Pix(n,k) on the kth column with its data voltage rewritten in the immediately preceding frame period is denoted by symbol "$i_n(t)$", and the pixel current i(n,k) of each pixel circuit Pix(n,k) on the kth column with its data voltage rewritten in the present frame period is denoted by symbol "$i_n(t+1)$". The pixel data indicating the display luminance of the nth pixel circuit Pix(n,k) on the kth column of the pixel data constituting the input image data of the present frame, that is, the pixel data corresponding to the data voltage to be written in the pixel circuit Pix(n,k) in the present frame period is denoted by symbol "dn".

In the image data correction processing, first, steps S10 to S18 illustrated in FIG. 7 are performed for each column of the pixel circuit 15 (step S1), thereby generating a signal corresponding to a data voltage to be written in the pixel circuits Pix(1,1) to Pix(1,M) on the first row and outputting the signal as a part of the driving image data signal Sdda. Hereinafter, the pixel circuits Pix(1,k) to Pix(N,k) on the kth column will be focused on, and the processing of steps S10 to S18 will be described.

First, of the new input image data, pixel data d1 for the kth column first pixel circuit 15, that is, the pixel circuit Pix(1,k) on the first row and kth column is received from the outside (step S10). Next, the value of the pixel current $i_1(t+1)$ is obtained from the pixel data d1 by the conversion table 204*t*, and the value of the pixel current $i_1(t+1)$ is stored into the memory 206 (step S11). Thereby, in the image data correction processing for the immediately preceding frame, the value of the pixel current $i_1(t)$ written in the memory 206 as the value of the first pixel current i (1,k) on the kth column (immediately-preceding-frame current value) is rewritten to the value of the pixel current $i_1(t+1)$ obtained in step S11 of the image data correction processing for the present frame (present-frame current value).

The power supply line current I1(1) in the data write period for the first pixel circuit Pix(1,k) on the kth column is given by the following equation as shown in Equation (15) above. In the following description, for convenience, "In" is used instead of "In(n)" as a symbol representing the nth power supply line current In(n) in the data write period for the nth pixel circuit Pix(n,k) on the kth column (n=1 to N).

$$I1=i_3(t)+i_4(t)+\ldots+i_N(t) \tag{16}$$

Therefore, the power supply line current I1 and the voltage V1 at the first connection point CN1 in the kth branch wire ELVk are obtained by the following equation (step S12):

$$I1=I0-i_1(t)-i_2(t) \tag{17}$$

$$V1=V0-I1(1)\cdot R \tag{18}$$

I0 in the above equation represents a current supplied from the trunk wire ELV0 to the kth branch wire ELVk (hereinafter referred to as "branch wire current on the kth column" or simply "branch wire current"). The value of the branch wire current I0, which is given by the following equation, is obtained in the image data correction processing for the immediately preceding frame (see steps S18 and S38):

$$I0=i_1(t)+i_2(t)+i_3(t)+i_4(t)+\ldots+i_N(t) \tag{19}$$

It is assumed that immediately after the organic EL display device 10 is activated, the branch wire current I0 is set to a predetermined value as a value corresponding to Equation (19) above.

Next, by using the voltage V1 obtained by Equation (18) above, the voltage drop ΔV1=V0−V1 at the first connection point CN1 on the kth branch wire ELVk is determined (step S14). In the data write period for the first pixel circuit Pix(1,k) on the kth column, the voltage held in the holding capacitor C1 is reduced by this voltage drop ΔV1 from the original value (see FIG. 2). Therefore, the pixel data d1 indicating the data voltage to be written in the first pixel circuit Pix(1,k) on the kth column in the present frame period is corrected based on the voltage drop ΔV1 such that the reduction is compensated (step S14). Hereinafter, the corrected pixel data for the pixel circuit Pix(1,k) is denoted by symbol "dc1".

Next, the corrected pixel data dc1 is output as a part of the driving image data signal Sdda (step S16).

Next, for obtaining the branch wire current I0 on the kth column to be used in the image data correction processing for the subsequent frame, the branch wire current I0 is set to the value of the pixel current $i_1(t+1)$ obtained in step S11 (step S18).

When steps S10 to S18 as described above are performed for k=1 to M, the variable n indicating the row number is then initialized to "1" (step S20). Thereafter, steps S30 to S38 illustrated in FIG. 7 are performed for each column of the pixel circuit 15 (step S3), whereby a signal corresponding to the data voltage to be written in the pixel circuits Pix(n,1) to Pix(n,M) of the nth row is generated and output as a part of the driving image data signal Sdda. Hereinafter, the pixel circuits Pix(1,k) to Pix(N,k) on the kth column will be focused on, and the processing of steps S30 to S38 will be described.

First, out of the new input image data, the pixel data dn+1 for the (n+1)th pixel circuit 15 on the kth column, that is, the pixel circuit Pix(n+1,k) on the (n+1)th row and kth column is received from the outside (step S30). Next, the value of the pixel current $i_{n+1}(t+1)$ is obtained from the pixel data dn+1 by the conversion table 204*t*, and the value of the pixel current $i_{n+1}(t+1)$ is stored into the memory 206 (step S31). Thus, the value of the pixel current $i_{n+1}(t)$ written in the memory 206 as the value of the (n+1)th pixel current i(n+1,k) on the kth column in the image data correction processing for the immediately preceding frame is rewritten to the value of the pixel current $i_{n+1}(t+1)$ obtained in step S31 of the image data correction processing for the present frame (see (A) and (B) of FIG. 6).

The (n+1)th power supply line current In+1 at the time of wiring the data voltage in the (n+1)th pixel circuit Pix(n+1,k) on the kth column is given by the following equation as shown in Equation (13) above:

$$In+1=In-i_{n+2}(t) \tag{20}$$

In in Equation (20) above represents the nth power supply line current of the branch wire ELVk in the data write period for the nth pixel circuit Pix(n,k) on the kth column, and the value of In has been obtained by this time point. The value of $i_{n+2}$ (t) in Equation (20) above is written in the memory 206 in the image data correction processing for the immediately preceding frame (see (B) of FIG. 6). Therefore, by using these values, the value of the nth power supply line current In+1 on the branch wire ELVk in the data write period for the (n+1)th pixel circuit Pix(n+1,k) on the kth column is obtained by Equation (20) above (step S32).

In the data write period for the (n+1)th pixel circuit Pix(n+1,k) on the kth column, the voltage Vn+1 at the (n+1)th connection point CNn+1 on the kth branch wire ELVk is given by the following equation from Equation (12) above:

$$Vn+1=Vn-\{n\cdot i_n(t+1)-n\cdot i_{n+2}(t)+In+1\}R \tag{21}$$

Here, the value of the voltage Vn at the nth connection point CNn on the kth branch wire ELVk has already been obtained at this point. Therefore, by using the value of voltage Vn, the value of the pixel current $i_{n+2}(t)$ stored in the memory 206, and the value of the power supply line current In+1 obtained by Equation (20) above, from Equation (21) above, the value of the voltage Vn+1 at the (n+1)th connection point CNn+1 on the kth branch wire ELVk is obtained (step S32).

Next, by using the voltage Vn+1 determined by Equation (21) above, the voltage drop ΔVn+1=V0−Vn+1 at the (n+1) th connection point CNn+1 on the kth branch wire ELVk is determined, and the pixel data dn+1 for the (n+1)th pixel circuit Pix(n+1,k) on the kth column is corrected based on the voltage drop ΔVN+1 (step S34). Here, the pixel data dn+1 is corrected so as to compensate for the reduction in the holding voltage (absolute value) of the holding capacitor C1 in the pixel circuit Pix(n+1,k) due to the voltage drop ΔVn+1. Hereinafter, the corrected pixel data for the pixel circuit (n+1,k) is denoted by symbol "dcn+1".

Next, the corrected pixel data dcn+1 is output as a part of the driving image data signal Sdda (step S36).

Next, in order to determine the branch wire current I0 on the kth column to be used in the image data correction processing for the subsequent frame, the value of the pixel current $i_{n+1}(t+1)$ is added to the value of the branch wire current I0 at the present time point obtained in step S31, thereby updating the value of the branch wire current (step S38). That is, the value of the branch wire current I0 is increased by the value of the pixel current $i_{n+1}(t+1)$.

When steps S30 to S38 as described above have been performed for k=1 to M, it is determined whether the variable n indicating row line number is smaller than N−1 (step S40). As a result of the determination, when the variable n is smaller than N−1, the value of the variable n is increased by "1", and the process then returns to the processing immediately after step S20. Thereafter, step S3 including steps S30 to S38, and steps S40 and S42, are repeatedly performed, and when the variable n becomes equal to N−1, the image data correction processing (FIG. 7) for the present frame is terminated.

The driving image data signal Sdda generated by the above-described image data correction processing and output from the display control circuit 20 constitutes the data-side control signal Scd together with the data-side timing control signal Sdct, and the data-side control signal Scd is provided to the data-side drive circuit 30 as described above. The data-side drive circuit 30 drives the data signal lines D1 to DM based on the data-side control signal Scd, and the scanning-side drive circuit 40 drives the scanning signal lines G1 to GN and the emission control lines E1 to EN based on the scanning-side control signal Scs from the display control circuit 20, whereby the data voltage indicated by the pixel data dci of each column corrected as described above, that is, the pixel data dc(i,k), is written in the corresponding pixel circuit Pix(i,k) (i=1 to N, k=1 to M).

<1.4 Effects>

According to the present embodiment as described above, the pixel data d(i,k) indicating the data voltage to be written in each pixel circuit Pix(i,k) is corrected such that the voltage drop ΔVi at the connection point CNi of the branch wire ELVk in the data write period is compensated (see FIGS. 4 and 7), and the data voltage indicated by the corrected pixel data dc(i,k) is written in the pixel circuit Pix(i,k) (i=1 to N, k=1 to M). Therefore, even when a voltage drop due to a current flowing in the branch wire ELVk occurs at one terminal of the holding capacitor C1 in each pixel circuit Pix(i,k) (the connection point CNi of the pixel circuit Pix(i,k) on the branch wire ELVk), a voltage corresponding to the original pixel data d(i,j) is held in the holding capacitor C1. Thereby, a decrease in display luminance due to a voltage drop caused by a current flowing in each branch wire ELVk of the power supply line is prevented, so that a decrease in display quality due to a luminance gradient or the like can be avoided.

According to the present embodiment, the display control circuit 20 performs correction to compensate for corrects the voltage drop caused by the current flowing in each branch wires ELVk, and the circuit configuration for driving (each pixel circuit 15 in) the display portion 11 is the same as the known one. Further, in the image data correction processing performed by the display control circuit 20 (image data correction circuit 204), the voltage Vn+1 (n=1 to N−1) at each connection point CNn+1 on the branch wire ELVk is sequentially determined using the calculated voltage Vn at the connection point CNn in accordance with the writing order (scanning order) of the data voltage in the pixel circuits Pix(1,k) to Pix(N,k) on each column (see steps S12 and S32 of FIG. 7, Equation (12), Equation (21)). Hence the voltage drop ΔVi at each connection point CNi of each branch wire ELVk can be obtained efficiently while the required memory amount is reduced, and correction processing can be performed based on the voltage drop ΔVi (see FIGS. 6 and 7). Therefore, it is possible to avoid the decrease in display quality due to the luminance gradient or the like caused by a voltage drop in each branch wire ELVk of the power supply line while preventing the increase in circuit and processing necessary for driving the pixel circuit 15, without lowering the ratio of the emission period.

Further, in the image data correction processing (FIG. 7) in the present embodiment, the voltage drop ΔVi at each connection point CNi of the branch wire ELVk can be accurately determined in consideration of the difference between the input image data of the immediately preceding frame and the input image data of the present frame (see FIGS. 6 and 7), and also in consideration of the fact that the pixel current (the drive current Id of the organic EL element OL) does not flow in the data write period and the reset period in each pixel circuit Pix(i,k) (see steps S12 and S32 of FIG. 6). Thus, the pixel data d(i,k) for each pixel circuit Pix(i,k) are corrected with high accuracy. Therefore, a decrease in display quality due to a luminance gradient or the like caused by a voltage drop in each branch wire ELVk in the power supply line can be avoided reliably as compared to the known art.

2. Second Embodiment

In the first embodiment, the data signal lines D1 to DM in the display portion 11 are directly connected to the data-side drive circuit 30, but instead, a demultiplexing circuit may be provided between the data-side drive circuit and the data signal lines D1 to DM, and a driving method may be employed in which each data signal D(j) (j=1 to M) generated in the data-side drive circuit is demultiplexed and given to two or more data signal lines (source lines) in the display portion 11 (hereinafter referred to as "source shared driving (SSD) method"). Hereinafter, an example of an organic EL display device employing such an SSD method will be described as a second embodiment.

<2.1 Configuration>

Figure 8:
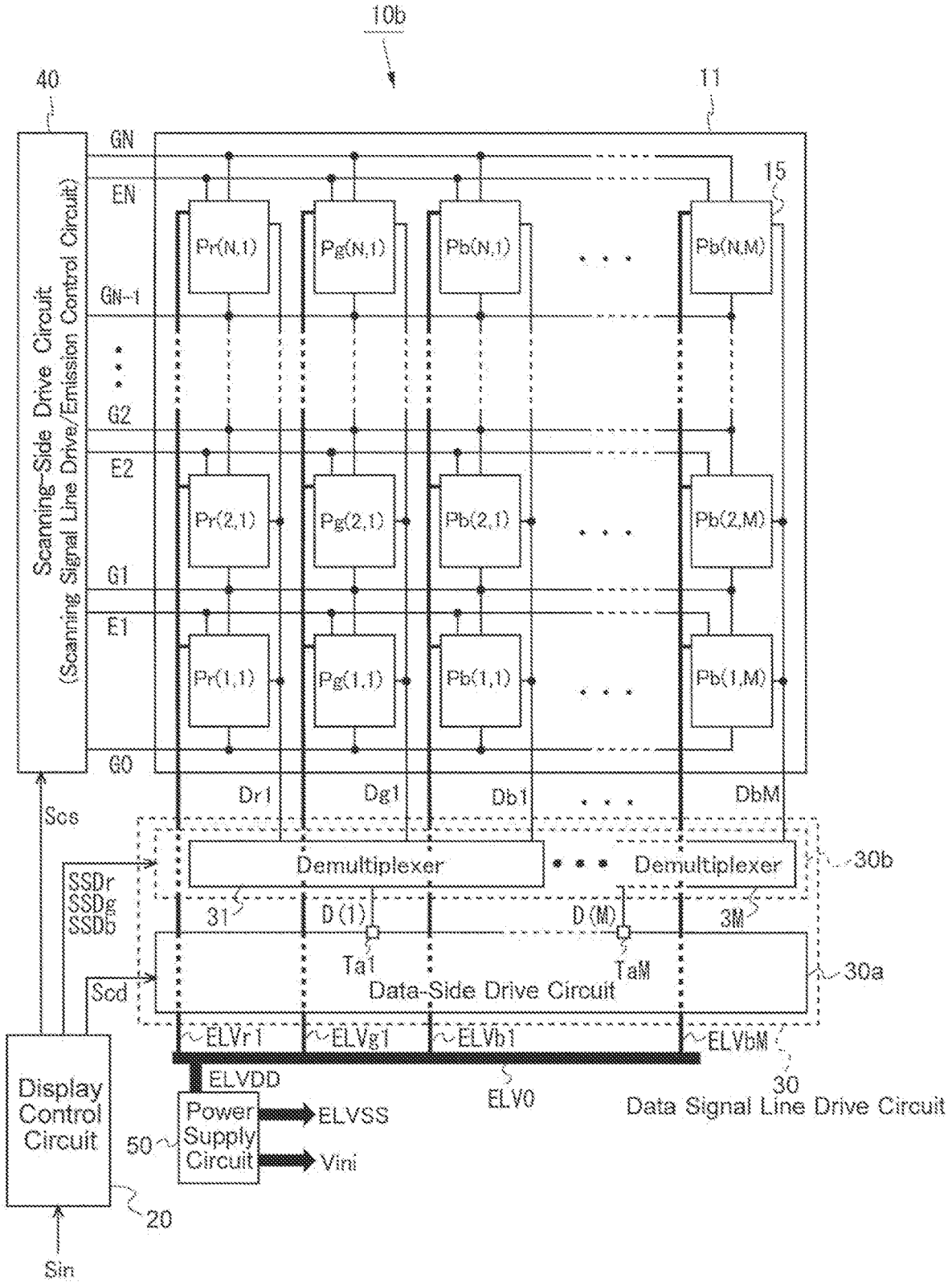
FIG. 8 is a block diagram illustrating the overall configuration of a display device according to a second embodiment.

FIG. 8 is a block diagram illustrating the overall configuration of a display device 10*b* according to the present embodiment. The display device 10*b* is an organic EL display device for performing internal compensation as in the first embodiment but is different from the first embodiment in that an SSD method having a multiplicity of 3 is employed. The display device 10*b* employs an SSD method in which color display based on three primary colors of red, green, and blue is performed, and with three data signal lines which correspond to the three primary colors taken as one set, three data signal lines in each set are driven in a time-division manner. Since the configuration of the present embodiment is the same as that of the first embodiment except for the configuration relating to these points, the same or corresponding portions are denoted by the same reference numerals, and detailed descriptions thereof will be omitted.

As illustrated in FIG. 8, the display device 10*b* according to the present embodiment includes a display portion 11, a display control circuit 20, a data signal line drive circuit 30, a scanning-side drive circuit 40 functioning as a scanning signal line drive circuit and an emission control circuit, and a power supply circuit 50.

In the display portion 11, there are provided M sets of (3M) data signal lines Dr1, Dg1, Db1 to DrM, DgM, DbM, each one set having three data signal lines made up of an R data signal line Drj, a G data signal line Dgj, and a B data signal line Dbj, which respectively correspond to red, green, and blue of the three primary colors, and N+1 scanning signal lines G0 to GN intersecting the data signal lines. Also, as in the first embodiment, N emission control lines E1 to EN are arranged along N scanning signal lines G1 to GN, respectively.

As illustrated in FIG. 8, in the display portion 11, 3M×N pixel circuits 15 are arranged in a matrix form along 3M data signal lines Dx1 to DxM (x=r, g, b) and N scanning signal lines G1 to GN, and each pixel circuit 15 corresponds to one of 3M data signal lines Dx1 to DxM (x=r, g, b) and corresponds to one of N scanning signal lines G1 to GN. In a case where the pixel circuits 15 are distinguished below, the pixel circuit corresponding to the ith scanning signal line Gi and the R data signal line Drj in the jth set will be referred to as an "R pixel circuit on the ith row and the jth set" and denoted by symbol "Pr(i,j)", the pixel circuit corresponding to the ith scanning signal line Gi and the G data signal line Dgj in the jth set will be referred to as a "G pixel circuit on the ith row and the jth set" and denoted by symbol "Pg(i,j)", the pixel circuit corresponding to the ith scanning signal line Gi and the B data signal line Dbj in the jth set will be referred to as a "B pixel circuit on the ith row and the jth set" and denoted by symbol "Pb(i,j)". Note that each pixel circuit Px(i,j) corresponds to any one of the N emission control lines E1 to EN (x=r, g, b). Since the configuration of each pixel circuit 15 (Px(i,j)) in the present embodiment is the same as the configuration of the pixel circuit 15 in the first embodiment, the same or corresponding portions are denoted by the same reference numerals, and descriptions thereof will be omitted(see FIG. 2).

The 3M data signal lines Dx1 to DxM (x=r, g, b) are connected to a demultiplexing circuit 30*b* to be described later in the data signal line drive circuit 30, and the N+1 scanning signal lines G0 to GN and the N emission control lines E1 to EN are connected to the scanning-side drive circuit (scanning signal line drive/emission control circuit) 40 as in the first embodiment.

As in the first embodiment, the display portion 11 is provided with a high-level power supply line (denoted by ELVDD as is the high-level power supply voltage) for supplying the high-level power supply voltage ELVDD and a low-level power supply line (denoted by ELVSS as is the low-level power supply voltage) for supplying the low-level power supply voltage ELVSS, as common power supply lines to each pixel circuit 15. As illustrated in FIG. 8, the high-level power supply line ELVDD includes a trunk wire ELV0 and 3M branch wires ELVx1 to ELVxM diverging from the trunk wire ELV0 and arranged along the 3M data signal lines Dx1 to DxM (x=r, g, b), and each pixel circuit 15 corresponds to any one of the 3M branch wires ELVx1 to ELVxM. The display portion 11 is also provided with an initialization voltage supply line (not illustrated) (denoted by symbol "Vini" the same as the initialization voltage) configured to supply an initialization voltage Vini to be used for a reset operation for initializing each pixel circuit 15. The high-level power supply voltage ELVDD, the low-level power supply voltage ELVSS, and the initialization voltage Vini are supplied from the power supply circuit 50. The power supply voltage (not illustrated) for operating the display control circuit 20, a data-side drive circuit 30*a*, and the scanning-side drive circuit 40 is also supplied from the power supply circuit 50.

As in the first embodiment, the display control circuit 20 receives the input signal Sin from the outside of the display device 10*b*, generates the data-side control signal Scd and the scanning-side control signal Scs based on the input signal Sin, and outputs the data-side control signal Scd to the data-side drive circuit 30*a* in the data signal line drive circuit 30 and the scanning-side control signal Scs to the scanning-side drive circuit 40. In addition, the display control circuit 20 outputs an R selection control signal SSDr, a G selection control signal SSDg, and a B selection control signal SSDb to the demultiplexing circuit 30*b* in the data signal line drive circuit 30.

As illustrated in FIG. 8, the data signal line drive circuit 30 includes the data-side drive circuit 30*a* and the demultiplexing circuit 30*b*. The data signal line drive circuit 30 functions as a driving signal generation circuit configured to generate data signals Dx(1) to Dx(M) for driving the data signal lines Dx1 to DxM (x=r, g, b).

The data-side drive circuit 30*a* has the same configuration as that of the data-side drive circuit 30 in the first embodiment and has M output terminals Ta1 to TaM. However, in the present embodiment, the SSD method having a multiplicity of 3 has been employed as described above, and hence the data-side drive circuit 30*a* functions as a time-division data signal generation circuit. That is, the data-side drive circuit 30*a* outputs, in each horizontal period, an R data signal Dr(j) to be applied to the R data signal line Drj, a G data signal Dg(j) to be applied to the G data signal line Dgj, and a B data signal Db(j) to be applied to the B data signal line Dbj as a data signal D(j) from the jth output terminal Taj in a time-division manner based on the data-side control signal Scd from the display control circuit 20 (j=1 to M). More specifically, each horizontal period includes three periods made up of a first period to a third period, the R data signal Dr(j) is output in the first period, the G data signal Dg(j) is output in the second period, and the B data signal Db(j) is output in the third period. In the ith horizontal period, the R data signal Dr(j) includes pixel data to be written in the R pixel circuit Pr(i,j) on the ith row and the jth set, the G data signal Dg(j) includes pixel data to be written in the G pixel circuit Pg(i,j) on the ith row and the jth set, and the B data signal Db(j) includes pixel data to be written in the B pixel circuit Pb(i,j) on the ith row and the jth set (i=1 to N, j=1 to M).

The demultiplexing circuit 30*b* has M demultiplexers made up of first to Mth demultiplexers 31 to 3M. Each demultiplexer 3*j* (j=1 to M) has the same configuration and demultiplexes the data signal D(j) output from the data-side drive circuit 30*a*. The R selection control signal SSDr, the G selection control signal SSDg, and the B selection control signal SSDb, which are output from the display control circuit 20, are supplied to all the demultiplexers 31 to 3M. The jth demultiplexer 3*j* has an input side connected to the jth output terminal Taj in the data-side drive circuit 30*a* and has an output side connected to the jth set of three data signal lines Drj, Dgj, Dbj. Therefore, each demultiplexer 3*j* includes an input terminal (hereinafter referred to as "input terminal TIj") connected to the terminal to which the data signal D(j) is input, that is, an output terminal Taj in the data-side drive circuit 30*a*, and a terminal (hereinafter referred to as "output terminal TOxj") connected to the data signal line Dxj (x=r, g, b). The jth demultiplexer 3*j* is configured in such a manner that three selection control signals SSDx (x=r, g, b) which are alternatively active are received, and the output terminal TOxj is electrically connected to the input terminal TIj when the selection control signal SSDx is at the low level (active), while the output terminal TOxj is electrically disconnected from the input terminal TIj to be in a high impedance state when the selection control signal SSDx is at the high level (inactive).

<2.2 Driving Method>

Next, the driving method for the display device 10*b* according to the present embodiment will be described with reference to FIGS. 2, 8, and 9, focusing on the three pixel circuits Pr(i,j), Pg(i,j), Pb(i,j) on the ith row and the jth set.

Figure 9:
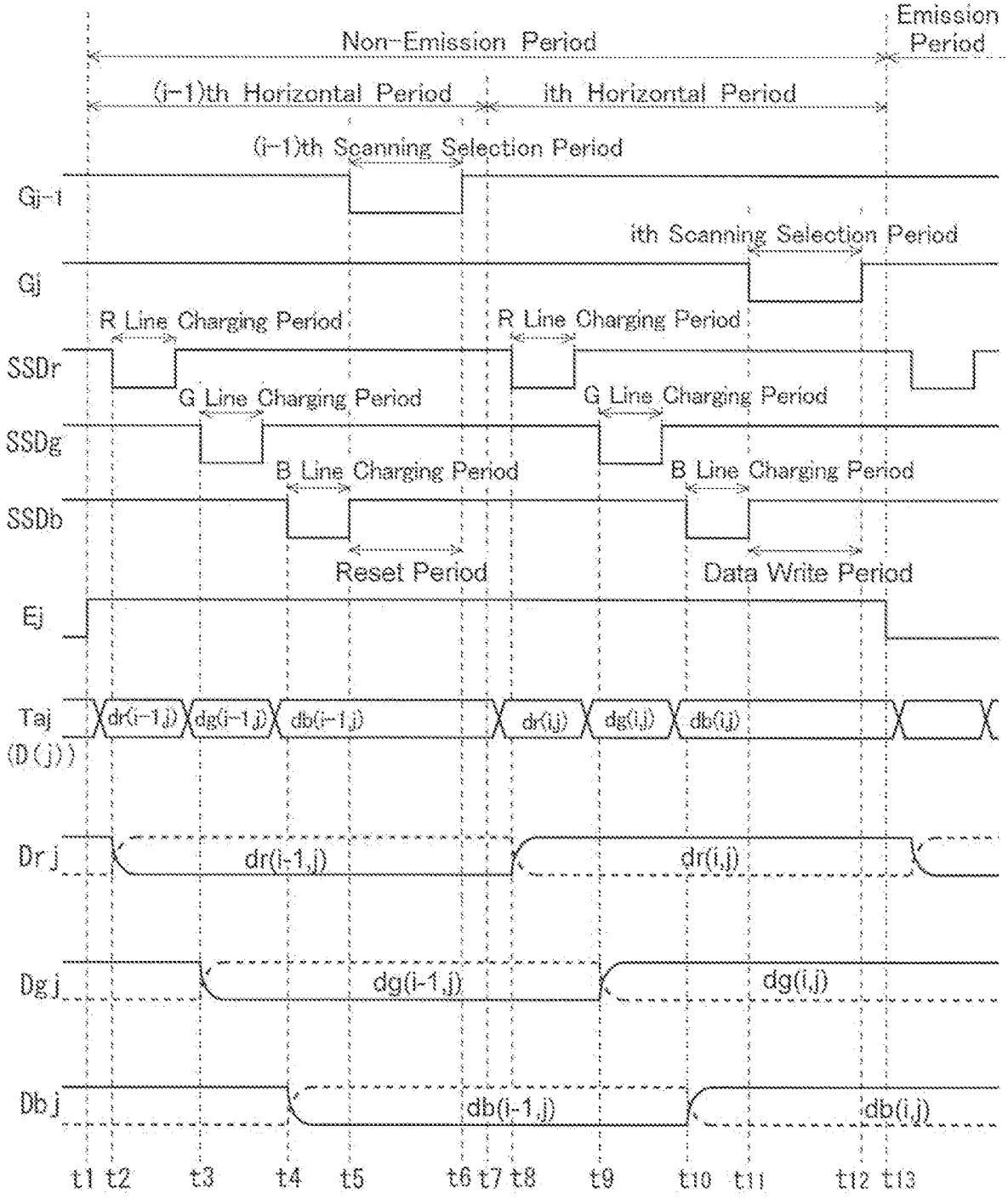
FIG. 9 is a signal waveform diagram for describing the driving of the display device according to the second embodiment.

FIG. 9 is a signal waveform diagram for describing the driving of the display device 10*b* according to the present embodiment, illustrating changes in each signal in initialization and pixel data writing in the three pixel circuits Pr(i,j), Pg(i,j), Pb(i,j) on the ith row and the jth set. In FIG. 9, the period from time t1 to time t13 is the non-emission period for the pixel circuits Px(i,1) to Px(i,M) (x=r, g, b) on the ith row. The period from time t1 to time t7 is the (i−1)th horizontal period, and the period from time t5 to time t6 is the selection period for the (i−1)th scanning signal line Gi−1, that is, the (i−1)th scanning selection period. The scanning selection period (t5 to t6) corresponds to a reset period for the pixel circuits Px(i,1) to Px(i,M) (x=r, g, b) on the ith row and corresponds to a data write period for pixel circuits Px(i−1,1) to Px(i−1,M) (x=r, g, b) on the (i−1)th row. The period from time t7 to time t13 is the ith horizontal period, and the period from time t11 to time t12 is the selection period for the ith scanning signal line Gi, that is, the ith scanning selection period. The scanning selection period (t11 to t12) corresponds to a data write period for the pixel circuits Px(i,1) to Px(i,M) (x=r, g, b) on the ith row and corresponds to a reset period for the pixel circuits Px(i+1,1) to Px(i+1,M) (x=r, g, b) on the (i+1)th row.

In the present embodiment, as illustrated in FIG. 9, in each horizontal period, the R selection control signal SSDr, the G selection control signal SSDg, and the B selection control signal SSDb sequentially become low levels (active) for each predetermined period in a period (hereinafter referred to as "pre-selection period") before the start time of the scanning selection period, so that the output terminal electrically connected to the input terminal TIj is sequentially switched among the three output terminals TOrj, TOgj, TObj (j=1 to M) in each demultiplexer 3*j*.

Meanwhile, from the output terminal Taj of the data-side drive circuit 30*a*, in the pre-selection period (t1 to t5) within the (i−1)th horizontal period, as illustrated in FIG. 9, the R data signal dr(i−1,j), the G data signal dg(i−1,j), and the B data signal db(i−1,j) are sequentially output in conjunction with the R selection control signal SSDr, the G selection control signal SSDg, and the B selection control signal SSDb. The voltages of the sequentially output R data signal dr(i−1,j), G data signal dg(i−1,j), and B data signal db(i−1,j) are supplied to the data signal lines Drj, Dgj, Dbj, respectively, by the demultiplexer 3*j* and held in the wiring capacitances of the data signal lines Drj, Dgj, Dbj, respectively (hereinafter, the wiring capacitance formed on each data signal line Dxj (x=r, g, b) will be referred to as "data line capacitance Cdxj"). That is, during the pre-selection period (t1 to t5), in a period when the R selection control signal SSDr is at the low level (hereinafter referred to as "R line charging period"), the data line capacitance Cdrj, which is the wiring capacitance of the R data signal line Drj, is charged at the voltage of the R data signal dr(i−1,j); in a period when the G selection control signal SSDg is at the low level (hereinafter referred to as "G line charging period"), the data line capacitance Cdgj, which is the wiring capacitance of the G data signal line Dgj, is charged at the voltage of the G data signal dg(i−1,j); and in a period when the B selection control signal SSDb is at the low level (hereinafter referred to as "B line charging period"), the data line capacitance Cdbj, which is the wiring capacitance of the B data signal line Dbj, is charged at the voltage of the B data signal db(i−1,i); As illustrated in FIG. 9, the voltage of the R data signal line Drj at the end of the R line charging period, the voltage of the G data signal line Dgj at the end of the G line charging period, and the voltage of the B data signal line Dbj at the end of the B line charging period are held at least during the scanning selection period (t5 to t6) within the horizontal period.

Thereafter, at the start time of the scanning selection period (t5 to t6), the voltage of the scanning signal line Gi−1 changes to the low level (active), and during the scanning selection period (t5 to t6), the voltage is maintained at the low level. However, in each pixel circuit Px(i,j) (x=r, g, b) on the ith row and the jth set, the voltage of the corresponding scanning signal line Gi is at the high level (inactive), so that the write control transistor M2 connected to the data signal line Dxj (x=r, g, b) is maintained in the off-state. On the other hand, the first initialization transistor M4 in each pixel circuit Px(i,j) (x=r, g, b) on the ith row and the jth set is in the on-state during the scanning selection period (t5 to t6) (see FIG. 2). Thus, the voltage Vg at the gate terminal of the drive transistor M1 is initialized to the initialization voltage Vini.

Also, in the pre-selection period (t7 to t11) within the ith horizontal period (t7 to t13), which is the next horizontal period, the R selection control signal SSDr, the G selection control signal SSDg, and the B selection control signal SSDb sequentially become low levels (active) for each predetermined period, so that the output terminal electrically connected to the input terminal TIj is sequentially switched among the three output terminals TOrj, TOgj, TObj (j=1 to M) in each demultiplexer 3*j*.

In the pre-selection period (t7 to t11) within the ith horizontal period, the R data signal dr(i,j), the G data signal dg(i,j), and the B data signal db(i,j) are sequentially output from the output terminal Taj of the data-side drive circuit 30*a* in conjunction with the R selection control signal SSDr, the G selection control signal SSDg, and the B selection control signal SSDb, as illustrated in FIG. 9. The voltages of the sequentially output R data signal dr(i,j), G data signal dg(i,j), and B data signal db(i,j) are supplied to the data signal lines Drj, Dgj, Dbj, respectively, by the demultiplexer 3*j* and held in the wiring capacitances of the data signal lines Drj, Dgj, Dbj, respectively. That is, during the pre-selection period (t7 to t11), the data line capacitance Cdrj, which is the wiring capacitance of the R data signal line Drj, is charged at the voltage of the R data signal dr(i,j) in the R line charging period, the data line capacitance Cdgj, which is the wiring capacitance of the G data signal line Dgj, is charged at the voltage of the G data signal dg(i,j) in the G line charging period, and the data line capacitance Cdbj, which is the wiring capacitance of the B data signal line Dbj, is charged at the voltage of the B data signal db(i,j) in the B line charging period. The voltage of the R data signal line Drj at the end of the R line charging period, the voltage of the G data signal line Dgj at the end of the G line charging period, and the voltage of the B data signal line Dbj at the end of the B line charging period are held at least during the scanning selection period (t11 to t12) within the horizontal period.

Thereafter, at the start time of the scanning selection period (t11 to t12), the voltage of the scanning signal line Gi changes to the low level (active), and during the scanning selection period (t11 to t12), the voltage is maintained at the low level. Thus, during the scanning selection period (t11 to t12), the write control transistor M2 and the threshold compensation transistor M3 in each pixel circuit Px(i,j) (x=r, g, b) on the ith row and the jth set are on the on-state (see FIG. 2).

Therefore, in the scanning selection period (t11 to t12), the voltage of the R data signal line Drj, that is, the voltage of the R data signal dr(i,j) held in the data line capacitance Cdrj, is written as pixel data in the R pixel circuit Pr(i,j) on the ith row and the jth set, the voltage of the G data signal line Dgj, that is, the voltage of the G data signal dg(i,j) held in the data line capacitance Cdgj, is written as pixel data in the G pixel circuit Pg(i,j) on the ith row and the jth set, and the voltage of the B data signal line Dbj, that is, the voltage of the B data signal db(i,j) held in the data line capacitance Cdbj is written as pixel data in the B pixel circuit Pb(i,j) on the ith row and the jth set.

By the driving as described above illustrated in FIG. 9, for each pixel circuit Px(i,j) (x=r, g, b) on the ith row and the jth set, the voltage Vg at the gate terminal of the drive transistor M1 is initialized in the (i−1)th scanning selection period (t5 to t6) corresponding to the reset period, and the data voltage subjected to threshold compensation is written in the holding capacitor C1 in the ith scanning selection period (t11 to t12) corresponding to the data write period (see FIG. 2). The specific operation of each pixel circuit Px(i,j) (x=r, g, b) in the reset period and the data write period are substantially the same as the operation of the pixel circuit Pix(i,j) on the ith row and the jth column in the reset period and the data write period in the first embodiment, and hence a description thereof will be omitted.

In the present embodiment as well, in the same manner as in the first embodiment, for the connection point CNi on each branch wire ELVxk of the high-level power supply line ELVDD with the pixel circuit Px(i,k) (x=r, g, b; i=1 to N; k=1 to M), the display control circuit 20 determines the voltage drop ΔVi caused by the current flowing in the branch wire ELVxk in the data write period for the pixel circuit Px(i,k), corrects the image data for the pixel circuit Px(i,k) out of the input image data based on the voltage drop ΔVi, and generates a driving image data signal Sdda to be supplied to the data-side drive circuit 30*a* (see FIGS. 4 to 7). In the first embodiment, the details of the image data correction processing have been described by focusing on the pixel circuits Pix(1,k) to Pix(N,k) on the kth column (FIGS. 4 and 6). In the present embodiment as well, the same description can be given by focusing on the kth set of the X-pixel circuits Px(1,k) to Px(N,k).

<2.3 Effects>

As described above, similarly to the first embodiment (see FIGS. 4 to 7), also, in the present embodiment (FIG. 8) employing the SSD method, for the connection point CNi of each branch wire ELVxk of the high-level power supply line ELVDD with the pixel circuit Px(i,k) (x=r, g, b; i=1 to N; k=1 to M), the voltage drop ΔVi caused by the current flowing in the branch wire ELVxk in the data write period for the pixel circuit Px(i,k) is obtained, and the image data for the pixel circuit Px(i,k) in the input image data is corrected based on the voltage drop ΔVi. Thereby, a decrease in display luminance due to a voltage drop caused by a current flowing in each branch wire ELVk is prevented, so that a decrease in display quality due to a luminance gradient or the like can be avoided, and the same effect as that of the first embodiment can be obtained.

3. Modified Example

The disclosure is not limited to the above embodiments, and various modifications can be made without departing from the scope of the disclosure.

For example, in the first and second embodiments, the pixel circuit 15 has been configured as illustrated in FIG. 2, but the configuration of the pixel circuit 15 is not limited thereto. The disclosure can be applied so long as a pixel circuit is used, the pixel circuit including a display element driven by a current, a holding capacitor that holds a data voltage for controlling a drive current of the display element, and a drive transistor that controls the drive current of the display element in accordance with the data voltage held in the holding capacitor, the pixel circuit being configured such that a first conductive terminal of the drive transistor is connected to a branch wire (power supply line) corresponding to the pixel circuit, a second conductive terminal of the drive transistor is connected to a second power supply voltage line via the display element, and a control terminal of the drive transistor is connected to the corresponding branch wire via the holding capacitor.

When a pixel circuit having a configuration different from that illustrated in FIG. 2 is used as in the above modification, the number of scanning selection periods included in one non-emission period may change depending on the configuration. In the above-described first and second embodiments, one non-emission period includes two scanning selection periods (FIGS. 3 and 9), but when a pixel circuit having a configuration different from that illustrated in FIG. 2 is used, one non-emission period may include only one scanning selection period or three or more scanning selection periods. In the first embodiment, the pixel circuit 15 (Pix(i,j)) having the configuration illustrated in FIG. 2 is used, and during the nth scanning selection period, in two pixel circuits Pix(n,k) and Pix(n+1,k) of the pixel circuits Pix(1,k) to Pix(N,k) on one column (kth column), the pixel currents $i_n$ and $i_{n+1}$ become zero at the same time. In contrast, when, for example, a pixel circuit including only one scanning selection period in one non-emission period is used, during the nth scanning selection period, in only one pixel circuit Pix(n,k) of the pixel circuits Pix(1,k) to Pix(N,k) on one column (kth column), the pixel current $i_n$ becomes zero. In this case, the power supply line current I1 in the data write period for the first pixel circuit Pix(1,k) on the kth column is given by the following equation instead of Equation (17) above:

$$I1=I0-i_1(t) \tag{22}$$

In this case, the power supply line current In+1 in the data write period for the (n+1)th pixel circuit Pix(n+1,k) on the kth column is given by the following equation instead of Equation (20) above:

$$In+1=In-i_{n+1}(t) \tag{23}$$

Further, in this case, in the data write period for the (n+1)th pixel circuit Pix(n+1,k) on the kth column, the voltage Vn+1 at the (n+1)th connection point CNn+1 on the kth branch wire ELVk is given by the following equation instead of Equation (21) above:

$$Vn+1=Vn-\{n\cdot i_n(t+1)-n\cdot i_{n+1}(t)+In+1\}R \quad (24)$$

In the first and second embodiments, the image data correction processing illustrated in FIG. 7 is performed in the display control circuit 20 by the image data correction circuit 204 using the memory 206, and the dedicated hardware for the image data correction processing is included in the image data correction circuit 204. However, instead of this, the image data correction circuit 204 may include a processor and a memory such as read-only memory (ROM), and the processor may execute a program stored in the memory to achieve the image data correction processing of FIG. 7 in software.

Further, in the first and second embodiments, as illustrated in FIG. 4, out of the connection points with the respective pixel circuits (n,k) in the respective branch wires ELVk of the high-level power supply line ELVDD, all the values of the resistances between the two mutually adjacent connection points are equally R, and the values of the resistances of the wiring portions from the power supply circuit 50 to the connection point CN1 of the pixel circuits Pix(1,k) (k=1 to M) on the first row and the kth column are also R, but the disclosure can be applied even in a case except for the case where all the resistance values are the same. That is, even in a case except for the case where all the resistance values are the same, the voltage drops ΔVn at the connection points CNn with the respective pixel circuits (n,k) on the respective branch wires ELVk of the power supply line are sequentially determined (n=1 to N), and the pixel data dn for the pixel circuit (n,k) is corrected based on the voltage drop ΔVn (with a configuration basically the same as that illustrated in FIGS. 5 to 7), thereby obtaining the same effect as in the first embodiment.

In the first and second embodiments, as illustrated in FIGS. 1, 4, and 8, the trunk wire ELV0 of the high-level power supply line ELVDD is disposed in a picture-frame region closer to the scanning signal line at the front (first scanned scanning signal line) G0 out of the two picture-frame regions along the scanning signal lines G0 to GN in the display panel including the display portion 11, but may be disposed in a picture-frame region closer to the scanning signal line at the rear (last scanned scanning signal line) GN out of the picture-frame regions. When the trunk wire ELV0 is disposed only in the picture-frame region closer to the scanning signal line GN at the rear, although the mathematical formulas expressions in steps S12 and S32 in FIG. 7 need to be slightly modified, the image data correction processing which produces the same effect as the above can be performed by the same procedure as that illustrated in FIG. 7.

In the second embodiment, as illustrated in FIG. 8, the SSD method having a multiplicity of 3 has been employed, but the multiplicity of the SSD method is not limited to this. That is, as is apparent from the configurations of the first and second embodiments illustrated in FIGS. 4 to 7, the disclosure can also be applied to a display device employing an SSD method having a multiplicity of 2 or 4 or more.

Although the embodiments and their modification have been described by taking the organic EL display device as an example, the disclosure is not limited to the organic EL display device but can be applied to a display device using a display element driven by a current. The display element usable here is a display element in which luminance, transmittance, or the like is controlled by a current, and for example, an organic EL element, that is, an organic light-emitting diode (OLED), an inorganic light-emitting diode, a quantum dot light-emitting diode (QLED), or the like can be used.

DESCRIPTION OF REFERENCE CHARACTERS

10,10*b*: ORGANIC EL DISPLAY DEVICE
11: DISPLAY PORTION
12: DISPLAY PANEL
15: PIXEL CIRCUIT
Pix(i,j): PIXEL CIRCUIT (i=1 TO N, j=1 TO M)
Pr(i,j): R PIXEL CIRCUIT (i=1 TO N, j=1 TO M)
Pg(i,j): G PIXEL CIRCUIT (i=1 TO N, j=1 TO M)
Pb(i,j): B PIXEL CIRCUIT (i=1 TO N, j=1 TO M)
20: DISPLAY CONTROL CIRCUIT
30: DATA-SIDE DRIVE CIRCUIT (DATA SIGNAL LINE DRIVE CIRCUIT)
40: SCANNING-SIDE DRIVE CIRCUIT (SCANNING SIGNAL LINE DRIVE/EMISSION CONTROL CIRCUIT)
204: IMAGE DATA CORRECTION CIRCUIT (IMAGE DATA CORRECTION UNIT)
206: MEMORY
Gi: SCANNING SIGNAL LINE (i=1 TO N)
Ei: EMISSION CONTROL LINE (i=1 TO N)
Dj: DATA SIGNAL LINE (j=1 TO M)
ELVDD: HIGH-LEVEL POWER SUPPLY LINE (FIRST POWER SUPPLY VOLTAGE LINE), HIGH-LEVEL POWER SUPPLY VOLTAGE
ELV0: TRUNK WIRE (OF HIGH-LEVEL POWER SUPPLY LINE)
ELVk: BRANCH WIRE (OF HIGH-LEVEL POWER SUPPLY LINE) (k=1 TO M)
ELVxk: BRANCH WIRE (OF HIGH-LEVEL POWER SUPPLY LINE) (x=r, g, b; k=1 TO M)
ELVSS: LOW-LEVEL POWER SUPPLY LINE (SECOND POWER SUPPLY VOLTAGE LINE), LOW-LEVEL POWER SUPPLY VOLTAGE
CNi: CONNECTION POINT WITH PIXEL CIRCUIT ON BRANCH WIRE (i=1 TO N)
OL: ORGANIC EL ELEMENT
C1: HOLDING CAPACITOR
M1: DRIVE TRANSISTOR
M2: WRITE CONTROL TRANSISTOR (WRITE CONTROL SWITCHING ELEMENT)
M3: THRESHOLD COMPENSATION TRANSISTOR (THRESHOLD COMPENSATION SWITCHING ELEMENT)
M4: FIRST INITIALIZATION TRANSISTOR (FIRST INITIALIZATION SWITCHING ELEMENT)
M5: FIRST EMISSION CONTROL TRANSISTOR (FIRST EMISSION CONTROL SWITCHING ELEMENT)
M6: SECOND EMISSION CONTROL TRANSISTOR (SECOND EMISSION CONTROL SWITCHING ELEMENT)
M7: SECOND INITIALIZATION TRANSISTOR (SECOND INITIALIZATION SWITCHING ELEMENT)
$i_p$: PIXEL CURRENT (p=1 TO N)
Ip: POWER SUPPLY LINE CURRENT (p=1 TO N)

The invention claimed is:

1. A display device having a plurality of scanning signal lines extending in a row direction, a plurality of data signal lines extending in a column direction and intersecting the plurality of scanning signal lines, and a plurality of pixel circuits arranged in a matrix form along the plurality of scanning signal lines and the plurality of data signal lines, the display device comprising:

a power supply line including first and second power supply voltage lines;

an image data correction unit configured to generate driving image data by correcting input image data that represents an image to be displayed;

a data signal line drive circuit configured to drive the plurality of data signal lines based on the driving image data generated by the image data correction unit; and a scanning signal line drive circuit configured to selectively drive the plurality of scanning signal lines, wherein the first power supply voltage line includes a trunk wire, and a plurality of branch wires diverging from the trunk wire and arranged along the plurality of data signal lines, respectively, each of the pixel circuits corresponds to any one of the plurality of scanning signal lines, corresponds to any one of the plurality of data signal lines, and corresponds to any one of the plurality of branch lines, includes a display element driven by a current, a holding capacitor configured to hold a data voltage for controlling a drive current of the display element, and a drive transistor configured to control the drive current of the display element in accordance with the data voltage held in the holding capacitor, and is configured such that a voltage of a corresponding data signal line is written in the holding capacitor as a data voltage when a corresponding scanning signal line is selected, in each of the pixel circuits, a first conductive terminal of the drive transistor is connected to a branch wire corresponding to the each pixel circuit, a second conductive terminal of the drive transistor is connected to the second power supply voltage line via the display element, and a control terminal of the drive transistor is connected to the corresponding branch wire via the holding capacitor, and the image data correction unit obtains an estimated value of a current that flows in a branch wire corresponding to any one of the plurality of pixel circuits when a data voltage is written in the any one pixel circuit, determines a voltage drop at a connection point between the branch wire and the any one pixel circuit based on the estimated value of the current, and corrects image data for the any one pixel circuit out of the input image data in accordance with the voltage drop, so as to generate image data corresponding to the data voltage to be written in the any one pixel circuit out of the driving image data, wherein the image data correction unit sequentially receives the input image data for each frame, acquires, as a present-frame current value, an estimated value of a current supplied from the power supply line to a preceding pixel circuit corresponding to any one of scanning signal lines selected before the scanning signal line corresponding to the any one pixel circuit in which the data voltage is to be written out of pixel circuits on one column connected to the branch wire corresponding to the any one pixel circuit in which the data voltage is to be written, based on the image data for the preceding pixel circuit out of the input image data of the present frame, and acquires, as an immediately-preceding-frame current value, an estimated value of a current supplied from the power supply line to a succeeding pixel circuit corresponding to any one of scanning signal lines selected after the scanning signal line corresponding to the any one pixel circuit in which the data voltage is to be written out of the pixel circuits on the one column based on the image data for the succeeding pixel circuit out of the input image data of the immediately preceding frame, and calculates the voltage drop based on the present-frame current value and the immediately-preceding-frame current value.

2. The display device according to claim 1, wherein the image data correction unit obtains an estimated value of a current supplied from the power supply line to a pixel circuit that is in an emission state and is connected to a branch wire corresponding to the any one pixel circuit in which the data voltage is to be written, except for the any one pixel circuit in which the data voltage is to be written, based on image data for said pixel circuit in the emission state, and calculates the voltage drop at the connection point at a time of writing the data voltage in the any one pixel circuit based on the estimated value of the current.

3. The display device according to claim 2, wherein each of the pixel circuits is configured such that when a scanning signal line corresponding to the each pixel circuit is selected, the each pixel circuit is in a non-emission state, and no current is supplied to the each pixel circuit from the power supply line.

4. The display device according to claim 3, wherein each of the pixel circuits is configured such that even when a scanning signal line to be selected immediately before the selection of the scanning signal line corresponding to the each pixel circuit is selected, the each pixel circuit is in a non-emission state, and no current is supplied to the each pixel circuit from the power supply line.

5. The display device according to claim 1, further comprising:

a plurality of emission control lines corresponding to the plurality of scanning signal lines, respectively; and an emission control circuit configured to drive the plurality of emission control lines, wherein each pixel circuit includes an emission control switching element provided in series with the display element in a path from the first power supply voltage line to the second power supply voltage line via the display element, each emission control line is connected to a control terminal of the emission control switching element in a pixel circuit corresponding to the corresponding scanning signal line, and the image data correction unit obtains an estimated value of a current supplied from the power supply line to a pixel circuit connected to an emission control line in an active state based on image data for the pixel circuit connected to the emission control line in the active state out of the pixel circuits connected to the branch wire corresponding to the any one pixel circuit in which the data voltage is to be written, the image data correction unit calculating the voltage drop at the connection point at a time of writing the data voltage in the any one pixel circuit based on the estimated value of the current.

6. The display device according to claim 1, wherein each of the pixel circuits is configured such that no current is supplied to the each pixel circuit from the power supply line when a scanning signal line corresponding to the each pixel circuit is selected, and the image data correction unit calculates the voltage drop at a time of writing the data voltage in the any one pixel circuit on the assumption that no current is supplied from the power supply line to the any one pixel circuit in which the data voltage is written.

7. The display device according to claim 1, further comprising a memory capable of storing respective current values of the plurality of pixel circuits and configured to store the present-frame current value for the preceding pixel circuit and store the immediately-preceding-frame current value for the succeeding pixel circuit, wherein each of the pixel circuits is configured such that no current is supplied from the power supply line to the each pixel circuit when a scanning signal line corresponding to the each pixel circuit is selected, the scanning signal line drive circuit selects the plurality of scanning signal lines in ascending order, the image data correction unit sequentially receives image data for each of the pixel circuits constituting the input image data of each frame in accordance with the selection of the plurality of scanning signal lines in ascending order, upon receipt of image data for a pixel circuit on an (i+1)th row and a jth column out of the input image data of the present frame, determines an estimated value of a current supplied from the power supply line to the pixel circuit on the (i+1)th row and the jth column as the present-frame current value based on the received image data, rewrites the current value of the pixel circuit on the (i+1)th row and the jth column stored in the memory to the present-frame current value of the pixel circuit, determines, from a voltage at a connection point between a pixel circuit on an ith row and the jth column and a branch wire on the jth column at a time of writing a data voltage in said pixel circuit, a voltage at a connection point between the pixel circuit on the (i+1)th row and the jth column and the branch wire on the jth column at a time of writing a data voltage in said pixel circuit, based on the present-frame current value of the pixel circuit on the ith row and jth column and the immediately-preceding-frame current value stored in the memory as a current value of a pixel circuit on the jth column corresponding to any one of the scanning signal lines selected after a scanning signal line corresponding to the pixel circuit on the ith row and jth column, calculates the voltage drop based on the determined voltage, and corrects the received image data for the pixel circuit on the (i+1)th row and the jth column in accordance with the calculated voltage drop so as to generate image data corresponding to the data voltage to be written in the pixel circuit on the (i+1)th row and jth column of the driving image data.

8. The display device according to claim 7, wherein each of the pixel circuits is configured such that no current is supplied from the power supply line to the each pixel circuit even when the scanning signal line to be selected immediately before the selection of the scanning signal line corresponding to the each pixel circuit is selected, and upon receipt of image data for the pixel circuit on the (i+1)th row and a jth column out of the input image data of the present frame, the image data correction unit determines, from a voltage at a connection point between the pixel circuit on the ith row and the jth column and the branch wire on the jth column at a time of writing a data voltage in said pixel circuit, a voltage at a connection point between the pixel circuit on the (i+1)th row and the jth column and the branch wire on the jth column at a time of writing a data voltage in said pixel circuit, based on the present-frame current value of the pixel circuit on the ith row and jth column and the immediately-preceding-frame current value stored in the memory as a current value of a pixel circuit on an (i+2)th row and the jth column, the image data correction unit calculating the voltage drop based on the determined voltage.

9. The display device according to claim 1, wherein the trunk wire is formed only in one picture-frame region along the plurality of scanning signal lines out of picture-frame regions adjacent to a display region in which the plurality of pixel circuits are arranged, and the plurality of branch wires diverge from the trunk wire and are each supplied with a power supply voltage from the trunk wire.

10. A method for diving a display device that includes a plurality of scanning signal lines extending in a row direction, a plurality of data signal lines extending in a column direction and intersecting the plurality of scanning signal lines, a power supply line including first and second power supply voltage lines, and a plurality of pixel circuits arranged in a matrix form along the plurality of scanning signal lines and the plurality of data signal lines, the method comprising:

an image data correction step of generating driving image data by correcting input image data that represents an image to be displayed;

a data signal line drive step of driving the plurality of data signal lines based on the driving image data; and a scanning signal line drive step of selectively driving the plurality of scanning signal lines, wherein the first power supply voltage line includes a trunk wire, and a plurality of branch wires diverging from the trunk wire and arranged along the plurality of data signal lines, respectively, each of the pixel circuits corresponds to any one of the plurality of scanning signal lines, corresponds to any one of the plurality of data signal lines, and corresponds to any one of the plurality of branch lines, includes a display element driven by a current, a holding capacitor configured to hold a data voltage for controlling a drive current of the display element, and a drive transistor configured to control the drive current of the display element in accordance with the data voltage held in the holding capacitor, and is configured such that a voltage of a corresponding data signal line is written in the holding capacitor as a data voltage when a corresponding scanning signal line is selected, in each of the pixel circuits, a first conductive terminal of the drive transistor is connected to a branch wire corresponding to the each pixel circuit, a second conductive terminal of the drive transistor is connected to the second power supply voltage line via the display element, and a control terminal of the drive transistor is connected to the corresponding branch wire via the holding capacitor, the image data correction step includes a current estimation step of obtaining an estimated value of a current that flows in a branch wire corresponding to any one of the plurality pixel circuits when a data voltage is written in the any one pixel circuit, and a driving data generation step of determining a voltage drop at a connection point between the branch wire and the any one pixel circuit based on the estimated value of the current and correcting image data for the any one pixel circuit in the input image data in accordance with the voltage drop, so as to generate image data corresponding to a data voltage to be written in the any one pixel circuit out of the driving image data, in the image data correction step, the input image data is input sequentially for each frame, in the current estimation step, an estimated value of a current supplied from the power supply line to a preceding pixel circuit corresponding to any one of scanning signal lines selected before the scanning signal line corresponding to the any one pixel circuit in which the data voltage is to be written out of pixel circuits on one column connected to the branch wire corresponding to the any one pixel circuit in which the data voltage is to be written, is acquired as a present-frame current value based on the image data for the preceding pixel circuit out of the input image data of the present frame, and an estimated value of a current supplied from the power supply line to a succeeding pixel circuit corresponding to any one of scanning signal lines selected after the scanning signal line corresponding to the any one pixel circuit in which the data voltage is to be written out of the pixel circuits on the one column, is acquired as an immediately-preceding-frame current value based on the image data for the succeeding pixel circuit out of the input image data of the immediately preceding frame, and in the driving data generation step, the voltage drop is calculated based on the present-frame current value and the immediately-preceding-frame current value.

11. The driving method according to claim 10, wherein the display device further includes a memory capable of storing respective current values of the plurality of pixel circuits and configured to store the present-frame current value for the preceding pixel circuit and store the immediately-preceding-frame current value for the succeeding pixel circuit, each of the pixel circuits is configured such that no current is supplied from the power supply line to the each pixel circuit when a scanning signal line corresponding to the each pixel circuit is selected, in the scanning signal line drive step, the plurality of scanning signal lines are selected in ascending order, the image data correction step further includes a memory write step of sequentially receiving image data for each of the pixel circuits constituting the input image data of each frame in accordance with the selection of the plurality of scanning signal lines in ascending order, and upon receipt of image data for a pixel circuit on an (i+1)th row and a jth column out of the input image data of the present frame, obtaining an estimated value of a current supplied from the power supply line to the pixel circuit on the (i+1)th row and the jth column as the present-frame current value based on the received image data, and rewriting the current value of the pixel circuit on the (i+1)th row and the jth column stored in the memory to the present-frame current value of the pixel circuit, and the driving data generation step further includes a voltage drop calculation step of determining, upon receipt of image data for the pixel circuit on the (i+1)th row and the jth column out of the input image data of the present frame, from a voltage at a connection point between a pixel circuit on an ith row and the jth column and a branch wire on the jth column at a time of writing a data voltage in said pixel circuit, a voltage at a connection point between the pixel circuit on the (i+1)th row and the jth column and the branch wire on the jth column at a time of writing a data voltage in said pixel circuit, based on the present-frame current value of the pixel circuit on the ith row and jth column and the immediately-preceding-frame current value stored in the memory as a current value of a pixel circuit on the jth column corresponding to any one of the scanning signal lines selected after a scanning signal line corresponding to the pixel circuit on the ith row and jth column, and calculating the voltage drop based on the determined voltage, and an image data correction step of correcting the received image data for the pixel circuit on the (i+1)th row and the jth column in accordance with the calculated voltage drop so as to generate image data corresponding to the data voltage to be written in the pixel circuit on the (i+1)th row and jth column out of the driving image data.

12. The driving method according to claim 11, wherein each of the pixel circuits is configured such that no current is supplied from the power supply line to the each pixel circuit even when the scanning signal line to be selected immediately before the selection of the scanning signal line corresponding to the each pixel circuit is selected, and in the voltage drop calculation step, upon receipt of image data for the pixel circuit on the (i+1)th row and the jth column out of the input image data of the present frame, from a voltage at a connection point between the pixel circuit on the ith row and the jth column and the branch wire on the jth column at a time of writing a data voltage in said pixel circuit, a voltage at a connection point between the pixel circuit on the (i+1)th row and the jth column and the branch wire on the jth column at a time of writing a data voltage in said pixel circuit is determined based on the present-frame current value of the pixel circuit on the ith row and jth column and the immediately-preceding-frame current value stored in the memory as a current value of a pixel circuit on an (i+2)th row and the jth column, and the voltage drop is calculated based on the determined voltage.

13. The driving method according to claim 10, wherein the trunk wire is formed only in one picture-frame region along the plurality of scanning signal lines out of picture-frame regions adjacent to a display region in which the plurality of pixel circuits are arranged, and the plurality of branch wires diverge from the trunk wire and are each supplied with a power supply voltage from the trunk wire.

* * * * *